US005571305A

United States Patent [19]

Uenosono et al.

[11] Patent Number: 5,571,305

[45] Date of Patent: Nov. 5, 1996

[54] ATOMIZED STEEL POWDER EXCELLENT MACHINABILITY AND SINTERED STEEL MANUFACTURED THEREFROM

[75] Inventors: Satoshi Uenosono; Hiroyuki Ishikawa; Kuniaki Ogura, all of Chiba, Japan

[73] Assignee: Kawasaki Steel Corporation, Japan

[21] Appl. No.: 298,596

[22] Filed: Aug. 31, 1994

[30] Foreign Application Priority Data

| | | | |
|---|---|---|---|
| Sep. 1, 1993 | [JP] | Japan | 5-217368 |
| Sep. 1, 1993 | [JP] | Japan | 5-217369 |
| Sep. 9, 1993 | [JP] | Japan | 5-223765 |
| Dec. 28, 1993 | [JP] | Japan | 5-336076 |
| Dec. 28, 1993 | [JP] | Japan | 5-337325 |

[51] Int. Cl.[6] ..... C21D 1/00

[52] U.S. Cl. ..... 75/246; 75/255

[58] Field of Search ..... 75/246, 255

[56] References Cited

U.S. PATENT DOCUMENTS

| | | | |
|---|---|---|---|
| 2,301,805 | 8/1939 | Harder | 75/22 |
| 4,069,044 | 1/1978 | Mocarski et al. | 75/243 |
| 4,266,974 | 5/1981 | Nitta et al. | 75/251 |
| 4,804,409 | 2/1989 | Kawano et al. | 75/246 |
| 4,954,171 | 9/1990 | Takajo et al. | 75/246 |
| 4,985,309 | 1/1991 | Ogura et al. | 428/570 |
| 5,108,493 | 4/1992 | Causton | 75/255 |
| 5,435,824 | 7/1995 | Dorsch et al. | 75/231 |

*Primary Examiner*—Charles T. Jordan
*Assistant Examiner*—Chrisman D. Carroll
*Attorney, Agent, or Firm*—Austin R. Miller

[57] ABSTRACT

Atomized steel powder having excellent machinability, containing about S 0.005 wt % to 0.3 wt %, Cr 0.03 wt % to 0.3 wt %, Mn 0.03 wt % to 0.5 wt %, O 0.30 wt % or less, and the balance Fe and incidental impurities, and sintered steel that can be manufactured therefrom. In particular, each of specific components is limited to a preferred range so that atomized steel powder exhibiting excellent machinability, dimensional accuracy and wear resistance and sintered steel that can be manufactured therefrom are provided.

9 Claims, No Drawings

ATOMIZED STEEL POWDER EXCELLENT MACHINABILITY AND SINTERED STEEL MANUFACTURED THEREFROM

BACKGROUND OF THE INVENTION

1. FIELD OF THE INVENTION

The present invention relates to steel powder for powder metallurgy, and particularly to sintered steel that can be manufactured therefrom, and more particularly to atomized steel powder having excellent machinability and to sintered steel that can be manufactured therefrom.

More particularly the present invention relates to atomized steel powder and produced sintered steel each having excellent machinability, satisfactory dimensional accuracy and wear resistance.

2. DESCRIPTION OF THE RELATED ART

Sintered steel is often manufactured by adding and mixing copper powder, graphite powder and other elements to steel powder and by pressing and molding the mixed powder to get desirable shaped green compact in a mold to make a sintered machine part. Such parts or the like usually have a density of about 5.0 g/cm$^3$ to 7.2 g/cm$^3$.

Although the powder metallurgy can produce a sintered body exhibiting excellent dimensional accuracy and having a complicated shape, parts requiring precision dimensional accuracy require a machining process, such as cutting or drilling after sintering. Accordingly, excellent machinability are often required.

In general, a product manufactured by powder metallurgy cannot easily be cut. Tools made by powder metallurgy often suffer from shorter life than those manufactured by melting processes. Machining, of course, increases the cost.

Products manufactured by powder metallurgy cannot easily be cut, at least partially, because presence of pores causes a non-continuous contact between the work piece and the cutter edge, or lowers thermal conductivity and thus raises the temperature at the site of the cutting process.

Efforts have heretofore been made to improve machinability by mixing a free cutting additive, such as S or MnS, with the steel powder. Because it acts as a lubricant reducing built-up edge formation or chip breaker.

In order to introduce S or MnS into the steel powder, Mn and S or MnS must be present in molten steel before it is atomized and formed into steel powder.

Japanese Patent Publication No. 3-25481 has suggested steel powder for powder metallurgy of a type characterized in that a small quantity, that is 0.1 wt % to 0.5 wt % of Mn, Si, C and the like are contained in molten steel, and S is added by 0.03 to 0.07 wt %, and they are sprayed with water or a gas. However, detailed performance of the steel powder has not been clarified.

Japanese Patent Publication No. 4-72905 has disclosed a free-cutting-type sinter forged part which contains two or more metal elements selected from a group consisting of 0.1 wt % to 0.9 wt % of Mn, 0.1 wt % to 1.2 wt % of Cr, 0.1 wt % to 1.0 wt % of Mo, 0.1 wt % to 2.0 wt % of Cu, 0.1 wt % to 2.0 wt % Ni, one or more elements selected from a group consisting of Nb, Al and V, S, C and Si.

Since sinter forged parts substantially establishe a true density, it is understood that substantially no pore is present. Therefore the machinability of the steel do not deteriorate due to reduction of thermal conductivity or interrupted cutting caused by pores. However, no discussion is made in the reference about ordinary sintered products of a type having a density of about 5 0 g/cm$^3$ to 7.2 g/cm$^3$ and including pores.

Sintered steel for powder metallurgy is ordinarily manufactured by adding and mixing Cu powder, graphite powder and the like to steel powder, by pressing the mixed powder to get a desirable shaped green compact in a mold and by sintering the green compact. The thus-manufactured sintered steel is applied for a sintered machine part or the like usually having a density of about 5.0 g/cm$^3$ to 7.2 g/cm$^3$ since a machine part of the foregoing type is manufactured from a long process including mixing copper powder and graphite powder with the steel powder, moving, transporting, molding and sintering, the dimensional change stability of the obtained sintered body can be deteriorated. Accordingly, a dimension controlling or correction process called a "sizing process" is usually provided after the sintering process.

However, such a sintered body is much too strong to be subjected to sizing for the purpose of correcting its dimensions. The dimensions cannot satisfactorily be corrected because of spring-back of the sintered body. The sizing process is also a costly and time-consuming additional process.

Accordingly, technologies for maintaining dimensional accuracy without sizing have been suggested. One is disclosed in Japanese Patent Publication No. 56-12304. The powder size distribution is rated to improve dimensional accuracy. In Japanese Patent Laid-Open No. 3-142342, dimensional changes due to sintering are estimated in accordance with the shape of the powder and the estimate is used to control dimensional accuracy.

On the other hand, influence of the composition of iron powder upon dimensional changes has been considered in Japanese Patent Publication No. 3-25481. A content of S is, by 0.03 wt % to 0.07 wt %, added to pure iron powder containing Mn by 0.1 wt % to 0.5 wt %, Si, C and balance iron, to prevent distortion caused by the sintering process, so as to decrease the ratio of article of dimensional interior quality taking place after sizing. The effect obtainable from the addition of S to iron powder has been mainly used to improve the machinability of the sintered body as well as preventing distortion of the sintered body disclosed in Japanese Patent Publication No. 3-25481. Improvement of machinability is also included in Japanese Patent Publication No. 3-25481.

Although disclosures have been made in Japanese Patent Publications No. 54-0457, 47-39832, 56-45964 and 61-253301, in each of which the machinability were intended to be improved by adding S to iron powder, no suggestion has been made that it can influence stability of dimensional changes.

In addition, dimensional changes take place excessively in performing sintering, in an actual manufacturing operation, because the added copper powder and graphite powder segregate easily when the powder is subjected to a movement. Movement is necessary to change a container after copper powder, graphite powder, lubricating agent and other materials have been added and mixed with steel powder. Movement is also required for various handling processes, such as transportation or supplying the mixed powder to a molding apparatus.

The degree of dimensional change undesirably varies, depending upon changes of the sintering conditions, as exemplified by sintering time and sintering temperature, for example.

However, disclosures made in, for example, Japanese Patent Publication No. 3-25481, are incapable of overcoming the problem of segregation or dimensional changes occurring in actual operation; they are due to various inevitable relevant factors.

The powder metallurgy product must usually possess good wear resistance in addition to the aforementioned characteristics. In many cases, it is conventional to add Cr. However, steel containing Cr is hardened excessively when sintered, and its machinability deteriorate. However, sintered bodies containing Cr are also required to have improved machinability.

Japanese Patent Laid-Open No. 61-253301 discloses alloy steel powder made by mixing water-sprayed mother alloy powder previously formed into an alloy with powder manufactured by roughly reducing an iron monoxide such as iron ore or mill scale, by using powder cokes serving as reducing agents; adjusting the mixture elements to desired quantities obtained after finishing reducing operation; and finish-reducing the mixed powder in a reducing atmosphere. In such a complicated manufacturing process, the cost cannot be reduced. What is worse, the disclosed basic performance, such as compressibility of the powder is unsatisfactory for practical use.

OBJECTS OF THE INVENTION

Accordingly, an object of the present invention is to overcome the problems of conventional technology and to provide a novel atomized steel powder exhibiting excellent machinability.

It is a further object to produce a sintered steel that can be manufactured by powder metallurgy.

It is a still further object to produce atomized steel powder exhibiting excellent machinability, dimensional accuracy and wear resistance, and an excellent sintered steel that can be manufactured from such atomized powder.

BRIEF SUMMARY OF THE INVENTION

According to this present invention an atomized steel powder exhibiting excellent cutting characteristic comprises about: S 0.005 wt % to 0.3 wt %; Cr 0.03 wt % to 0.3 wt %; Mn 0.03 wt % to 0.5 wt %; 0 0.3 wt % or less; and the balance consisting of Fe and incidental impurities.

According to a preferred embodiment of the invention atomized steel powder exhibiting excellent machinability and dimensional accuracy comprises about: S 0.005 wt % to 0.3 wt %; Cr 0.03 wt % to less than 0.1 wt %; Mn 0.03 wt % to 0.5 wt %; O 0.30 wt % or less; and the balance Fe and incidental impurities.

Further according to the present invention, there is provided an atomized steel powder exhibiting excellent machinability and wear resistance, comprising about: S 0.05 wt % to 0.12 wt %; Cr 0.1 wt % to 0.3 wt %; Mn 0.03 wt % to 0.1 wt %; O 0.3 wt % or less and the balance Fe and incidental impurities.

According to a further preferred form of the present invention the atomized steel powder further comprises C about 0.4 wt % to 1.5 wt % in admixture and the mixed substance is molded and sintered.

It is a further object to produce a superior sintered steel product from the novel atomized steel powders of this invention.

Other and further objects, features and advantages of the invention will be appear more fully from the following description, which is intended as exemplary and is not intended to define or to limit the scope of the invention except as defined in the appended claims.

Operation

The limitation of amount of each of the components S, Cr and Mn serving as components of the present invention to a preferred range surprisingly enables realization of a novel atomized steel powder exhibiting excellent machinability, dimensional accuracy and wear resistance, and enables manufacture of superior sintered steel products.

DETAILED DESCRIPTION OF PREFERRED EMBODIMENTS

In order to meet the recent trend toward improving the performance of sintered steel products, steel powder must have, for basic performance, green density of 6.85 g/cm$^3$ maintained under a molding pressure of, for example, 5 t/cm$^2$. This is normally required to meet usual industrial levels required for the steel powder. Therefore, development of the steel powder must be performed in such a manner that the foregoing condition is met. Base steel powder for use in a partially alloyed steel powder is a method usually employed to obtain maximum strength, and must have further improved compressibility.

In addition, the process for manufacturing the steel powder must be as simple and stable as is possible. Therefore, if steel powder was manufactured by atomization process, complicated and/or unstable manufacturing method, wherein the atomized steel powder is mixed with reducing powder, has to be avoided to be employed. On the other hand atomized powder can be obtained through simple process.

Subject to the foregoing preconditions, we have created a steel powder exhibiting excellent machinability and have discovered criticality in providing atomized steel powder with Cr in an amount of about 0.03 wt % or more, Mn and S. We have studied sintered steel manufactured from such a powder and have energetically studied the atomized steel powder and the sintered steel that can be manufactured therefrom. We have discovered that providing Mn in a quantity ranging from about 0.03 wt % or more to about 0.5 wt % enables Cr to coact beneficially with Mn and S, surprisingly causing graphite to be deposited in pores by about 0.05 wt % or more. Further, the average size of the deposited graphite can be made to be about 10 μm or larger. It was surprisingly found that the machinability of the product were improved significantly when the average size of the graphite present in the pores was about 10 μm or larger, when the quantity of the same exceeded about 0.05 wt % or more, and when simultaneously MnS precipitated into the iron particles.

Hitherto, we have believed, in the industrial/wrought material field, that the machinability might be improved by enlarging a free cutting inclusion such as MnS. However, in the conventional technical level in the powder metallurgy field, sintering of green compact from prealloyed steel powder containing Mn and S results in sintered steel. Sintered steel has small size MnS to be precipitated which is not larger than 5 μm, and the average size of which is about 1 μm. As a result, it has been difficult to improve machinability significantly. Moreover, the added graphite is undesirably completely segregated into the iron powder during the sintering process, thus resulting in the fact that substantially no graphite is left in the pores in the sintered body.

In the present invention, the main inclusions for improving machinability comprise residual graphite and MnS. It is particularly the residual graphite that contributes to the improvement. The typical average size of the residual graphite in the present invention is about 10 μm or larger, and is about 10 times or larger than the size of the MnS. If such large size of residual graphite particles are contained in an amount of 0.05 wt % or more, the machinability are improved very effectively. However, if the content of Mn is less than about 0.03 wt %, wherein substantially no precipitation of MnS takes place, there is no significant improvement of machinability. The important fact was found clearly that the combined effects of MnS and residual graphite in a quantity of about 0.05 wt % or larger enable creation of a sintered steel exhibiting excellent machinability.

Furthermore, a fact was found that prealloyed steel powder obtained atomixed molten steel containing Ni, Mo, Nb, V, Si and Al in addition to Cr, Mn and S according to present invention or steel powder containing Ni, Cu and Mo partially diffused of which base powder with composition according to present invention has satisfactory strength as well as excellent machinability in spite of containing Cr, Mn and S.

The reason why the sintered steel can be produced having the structure according to the present invention, in which graphite is present in pores, is that a coaction of Cr and S partially prevents diffusion (carbonization) of C into γ particles during the sintering process, and thus graphite having an average size of about 10 μm or larger is left in the pores and is present after the sintering process has been performed. Simultaneously, Mn and S added to the atomized steel powder, as a prealloyed alloy, form MnS. Therefore, a structure in which MnS having a diameter of about 5 μm or less is present in both the iron particle and the grain boundary.

We turn now to a discussion of reasons for limiting the components in the steel powder exhibiting excellent machinability, and in a sintered body that can be manufactured therefrom. In addition, we consider now why the steel powder according to the present invention is preferably limited to steel powder containing Cr and S into a prealloy.

Since the steel powder according to the present invention causes graphite to remain present in pores in the sintered body due to coaction between Cr and S, Cr and S must be uniformly distributed in the powder to uniformly distribute graphite in the sintered body.

Steel powder that Cr and S doesn't uniformly distribute causes deterioration of machinability.

We now consider, element by element, the criticality of limitations, element by element, according to this invention.

S: about 0.005 wt % to 0.3 wt %

Since S has been found to prevent partial diffusion of C into γ particles due to coaction with Cr, forming a sintered steel structure in which graphite is present in pores after the sintering process has been performed, S is added and another reason of S addition is that S acts as a source for generating MnS. The lower limit of about 0.005 wt % is important since S can have strong affinity with Mn. A major portion of S reacts with Mn and precipitates if the content is less than about 0.005 wt %. Furthermore, the cooperation of Cr and S partially prevents diffusion of C into iron powder particles, causing C to be left present as graphite in the grain boundary and in the pores. Therefore, if the content of S is less than about 0,005 wt %, the effect of partially preventing diffusion of C into the iron powder particles cannot be obtained, resulting in diffusion of a major portion of C in the particles. As a result the quantity of graphite left in the boundary pores is reduced and thus the cutting characteristic cannot be improved. It is important to limit S to about 0.3 wt % because a quantity larger than about 0.3 wt % can easily generate soot during the sintering process. This raises a danger that the sintering furnace will be damaged.

If S is added in a quantity larger than about 0.3 wt %, compressibility deteriorates and the quantity of C diffused in the steel powder is reduced. Thus, ferrite phase increases, causing strength to deteriorate.

Cr: about 0.03 wt % to 0.3 wt %

Cr is present because its coaction with S partially prevents diffusion of C into γ particles so as to form a sintering steel structure in which graphite is left present in the pores after the sintering process has been performed.

Cr is limited to the range from about 0.03 wt % or more to about 0.3 wt % or less because if the Cr content is less than about 0.03 wt % the quantity of residual graphite is less than about 0.05 wt % and the machinability deteriorate. If the Cr content is more than about 0.3 wt %, the solid solution effect of Cr deteriorates machinability.

Mn: about 0.03 to 0.5 wt %

Manganese is added to serve as a Mn source to form MnS. The content of Mn is controlled to about 0.03 wt % or more and as well as about 0.5 wt % or less. If Mn is less than about 0.03 wt %, MnS precipitates in an insufficient quantity and satisfactory machinability cannot be obtained. If Mn is added in a quantity larger than about 0.5 wt %, the quantity of the residual graphite is reduced and the machinability deteriorate. Mn is consumed to form MnS during the atomizing process and the finish reducing process. If the content of Mn is too large, the quantity of S is reduced with respect to the combination of Cr and S which are effective to cause graphite to remain. Thus, carbonization proceeds during the sintering process, causing the quantity of residual graphite to be reduced. In addition, compressibility deteriorates.

O: about 0.3 wt % or less

The quantity of O in the powder is limited to about 0.3 wt % or less. If the 0 quantity is larger than about 0.3 wt %, the ratio of that portion of added graphite that is reduced as C is increased. Thus, residual graphite is reduced. Furthermore, Si and Al in the powder do not serve as precipitation sites but are formed into $SiO_2$ and $Al_2O_3$ solely present in the sintered body. In the foregoing case, the machinability deteriorate.

Since Si and Al are, similarly to Cr and S, effective to partially prevent diffusion of C into γ particles, and it as precipitate $SiO_2$ and $Al_2O_3$ serving as precipitating sites when MnS precipitates from the molten steel.

Si, Al: about 0.1 wt % or less

Each of Si and Al is controlled to be about 0.1 wt % or less because if the content of either Si or Al is larger than about 0.1 wt %, the quantities of $SiO_2$ and $Al_2O_3$ are enlarged excessively and the machinability deteriorate rapidly. If the quantities of added Si and Al are too small, the effect of the addition is insufficient. Therefore, it is preferable that the quantity of each of Si and Al be about 0.01 wt % to 0.03 wt %.

Since Ni, Mo, Nb and V are added as prealloyed component in order to obtain desired strength due to the hardenability and precipitation hardening. By atomizing molten steel containing Ni and Mo in addition to Cr and S, the residual graphite is enlarged and thus the deterioration of machinability occurring due to the rise in the hardness of the sintered steel can be prevented.

Ni, Mo: about 4.0 wt % or less

The quantity of added Ni is controlled at about 4.0 wt % or less and added Mo at about 4.0 wt % or less. If each quantity is more than about 4.0 wt %, solid solution hardening deteriorates machinability. It is preferable that each quantity be about 2.0 wt % or less. If each quantity is about 2 wt % or less, the average size of residual graphite is about 30 μm or larger and thus the deterioration of machinability occurring due to solid solution hardening of Ni and Mo can be minimized.

Nb: about 0.05 wt % or less

V: about 0.5 wt % or less

The quantity of addition of Nb is determined to be about 0.05 wt % or less, while that of V is determined to be about 0.5 wt % or less. If the quantities are larger than about 0.05 wt % and about 0.5 wt % respectively, generated carbides or excessive precipitation deteriorate machinability. The preferred ranges are about 0.01 wt % to 0.03 wt % and about 0.1 wt % to 0.4 wt %, respectively.

Similarly to the ordinary alloy steel powders, Ni, Mo and Cu are, as partially diffused alloy components, added in order to obtain desired strength. For example, Ni source, Mo source and Cu source are preferable to Ni powder, Mo powder or $MoO_3$ powder and Cu powder respectively. The quantities of Ni, Mo and Cu are determined to be about 5 wt % or less, about 3 wt % or less and about 5 wt % or less, respectively. If the quantities are larger than about 5 wt %, about 3 wt % and about 5 wt % respectively, solid solution hardening deteriorates machinability. It is preferable that these quantities be about 4 wt % or less, about 2 wt % or less and about 2 wt % or less, respectively. By partially alloyed Ni, Mo and Cu in the foregoing ranges, the size of the residual graphite is enlarged to about 30 μm though the reason for this has not been clarified yet. Thus, deterioration of machinability occurring due to solid solution hardening can be minimized. Graphite: about 0.4 wt % to 1.5 wt %

Graphite is added to obtain desired strength by solid-solution hardening in steel and to serve as a source of graphite to be left positioned in pores in accordance with the present invention. The quantity of added graphite is determined to be about 0.4 wt % to 1.5 wt % because a quantity less than about 0.4 wt % gives unsatisfactory strength. If the quantity is larger than about 1.5 wt %, proeutectoid cementite precipitates, causing machinability to deteriorate. Therefore, it is preferable that the quantity be controlled at about 0.6 wt % to 1.2 wt %. If Cr, Mn and S are present in their preferred ranges while graphite is present in the foregoing range, the average size of graphite in the sintered steel is about 10 μm or larger. Thus, machinability can be improved.

That is, if the steel powder according to the present invention is sintered in an Fe—C system or an Fe—Cu—C system, sintered steel containing MnS and residual graphite positioned in pores and exhibiting excellent machinability can be obtained.

The sinter forged steel which has been disclosed in Japanese Patent Publication No. 4-72905 and which contains substantially no pores is enabled to have somewhat improved machinability due to the presence of S. Such sinter forged steel is completely different from the technology according to the present invention wherein MnS and residual graphite present in pores improve the machinability of sintered steel containing pores.

As contrasted with the sinter forged steel according to Japanese Patent Publication No. 4-72905 which contains C at 0.4 wt %, the present invention contains a radically larger quantity of graphite by about 0.4 wt % to 1.5 wt % which generates residual graphite and get a strength due to solid-solution hardening in the base.

As described above, the sizes of residual graphite and that of MnS particles considerably affect machinability. The steel powder created by the present invention contains residual graphite in an amount of about 0.05 wt % or more, the average size is about 10 μm or more and the size of MnS is about 1 μm. Therefore, excellent machinability can be obtained.

We turn now to a description of atomized steel powder having composition wherein S, Cr and Mn are limited to preferable ranges and are thus enabled to exhibit excellent machinability and dimensional accuracy, and to create sintered steel that can be manufactured therefrom.

In order to achieve the foregoing objects, we have thoroughly investigated the influence of the added elements upon dimensional change during at the sintering process. We have found that addition of Cr, Mn and S in a composite manner and limiting the quantity of O enables creation of an atomized steel powder capable of preventing changes of dimensional change and having excellent machinability and capable of creating a sintered steel of high quality.

That is, the atomized steel powder contains S about 0.005 wt % to about 0.3 wt %, Cr about 0.03 wt % to less than about 0.1 wt %, Mn about 0.03 wt % to about 0.5 wt %, 0 about 0.3 wt % or less, and the balance consisting Fe and incidental impurities. If necessary or desired, one or more elements may be present which are selected from the group consisting of about 4.0 wt % or less of Ni, about 4.0 wt % or less of Mo, about 0.05 wt % or less of Nb, about 0.5 wt % or less of V, about 0.1 wt % or less of Si and about 0.1 wt % or less of Al. One or more substances selected from the group consisting of about 5.0 wt % or less of an Ni source, about 3.0 wt % or less or of an Mo source and about 5.0 wt % or less of a Cu source may be partially alloyed to the foregoing atomized steel powder.

Preferred ranges of S, Cr and Mn in the steel powder, and in the sintered steel that can be manufactured therefrom, will now be described.

S: about 0.005 wt % to 0.3 wt %

S is included to partially prevent diffusion of C into γ particles due to multiplier effect obtained from Cr and S so as to form a sintered steel structure in which graphite is left positioned in pores after the sintering process has been performed. The quantity of S is limited to about 0.005 wt % or more because if it is less than about 0.005 wt %, C is undesirably completely diffused in the iron powder particles and the residual of graphite in the boundary pores is too small to improve the foregoing machinability. This leads to a machinability that is unsatisfactory; further, only poor dimensional accuracy can be obtained. The quantity of S is limited to about 0.3 wt % or less because if S is added in a quantity larger than about 0.3 wt % compressibility deteriorates and the quantity of C that diffuses into the iron powder becomes too small. In this case, ferrite phases increase, causing strength to deteriorate. By making the quantity of S about 0.05 wt % to 0.15 wt %, the dimensional change during the sintering process can further be stabilized and excellent machinability can be obtained.

Cr: about 0.03 wt % to less than 0.1 wt %

Cr partially prevents diffusion of C into γ particles due to a multiplier effect obtained from Cr and S so as to form a sintered steel structure in which graphite is left positioned in pores after the sintering process has been performed. The reason the quantity of Cr is limited to about 0.03 wt % or more and as well as less than about 0.1 wt % is as follows: if the content of Cr is less than about 0.03 wt %, dimensional accuracy becomes unsatisfactory as experienced with comparative examples shown in Table 2. If Cr is 0.1 wt % or larger, dimensional accuracy deteriorates. A preferred quantity range for Cr is about 0.06 wt % to 0.09 wt %. If that quantity is within the foregoing range, the dimensional change during the sintering process can further be stabilized and excellent machinability can be obtained.

Mn: about 0.03 wt % to 0.5 wt %

Since Mn is added to form MnS, Mn affects primarily the machinability but not dimensional accuracy. Therefore, the preferred range is about 0.03 wt % to 0.5 wt % as described above.

The preferred ranges for the residual components and the reasons for determining them are as described above.

The structure in which Cr and S are present in atomized steel powder enables the following effects to be obtained: (1) the dimensional change during the sintering process can be stabilized, and (2) graphite is left in pores and grain boundary of the sintered steel and thus the machinability are significantly improved with coexistent with MnS.

As for the effect of stabilizing dimensional changes, the results of a variety of actual experiments we have carried out lead to the conclusion that the effect of the presence of Cr and that of free S is as follows: one effect obtainable from the coexistence of Cr and free S in iron powder is to partially prevent the diffusion of C into γ particle during the sintering process. Even if the quantity of added graphite is varied, the quantity of C that is difused into the iron powder is maintained at a substantially constant quantity. The important factors for determining dimensional change during the sintering process are C swelling occurring due to the diffusion of C into γ particles during the sintering process and the fact that the degree of penetration of Cu into grain boundary (so-called Cu swelling) depends upon the solid solution quantity of C diffusion in γ particles in the case of an Fe—Cu—C system. Therefore, the process of sintering the powder according to the present invention enables the quantity of C swelling to be reduced with respect to the diffusion of the quantity of added graphite in the case of an Fe—C system. Further, in an Fe—Cu—C system, scatter of both quantity of the Cu and C swelling can be reduced with respect to the foregoing variation of added graphite.

A further effect was discovered in that the presence of Cr and free S in iron powder stabilizes dimensional changes, even if the time in which the sintering operation is performed is changed during the sintering process. It is believed that this is because shrinkage experienced when carbon is removed from iron powder can be restricted.

The foregoing effects prevent changes of dimensional changes during the time of the sintering process. The foregoing effect can be obtained if Cr and free S coexist, as will be described later in the description of the Examples. If only either of the single elements meets the composition range according to the present invention, a satisfactory effect cannot be obtained.

Although the principle of the foregoing effect obtainable from Cr and free S has not been clarified yet, it can be considered that the two types of elements coact mutually because of the fact that the foregoing effect cannot be obtained from either of the elements taken alone.

The effect of improving machinability obtainable from the presence of Cr and free S will now be described. The machinability of sintered steel having a structure in which graphite is present in pores with coexistent with MnS can be improved due to the effect of residual graphite into the pores and MnS serving as a lubricating agent acting on a tool cutting face when a machining process is performed, and the effect of restricting interrupted cutting. The foregoing mechanism capable of improving machinability is a novel technology which is completely different from conventional technology using MnS or the like as described above. The mechanism according to the present invention enables the machinability to be significantly improved as compared with the structure in which MnS is solely present.

It is difficult to obtain a steel powder having the foregoing composition from reduced iron powder in such a manner that the components and composition are changed to raise the ratios of Cr and S. Also in atomized steel powder, the foregoing composition cannot be realized by simply adding S to pure iron molten steel. That is, the foregoing steel powder having the foregoing composition can be realized by a method comprising the steps of: controlling a desulfurization reaction in a converter or an electric furnace or positively adding S to make the quantity of S equal to the desired quantity; adding Cr by a ladle or the like after the rectifying process has been performed (if Cr is not added, the quantity present is usually about 0.01 wt % or less); spraying the mixture by water atomizing or the like to obtain steel powder, and performing a post process, such as a drying process or a reducing annealing method to control the quantity of oxygen present.

The atomized steel powder containing S, Cr and Mn, the composition of each of which is limited in range, and thus having excellent machinability and wear resistance, and the sintered steel that can be manufactured therefrom will now be described.

Under the foregoing precondition, the inventors of the present invention intended to develop steel powder exhibiting an excellent machinability by paying attention to atomized steel powder containing Cr by 0.03 wt % or more, Mn and S and sintered steel that can be manufactured therefrom and energetically studied the atomized steel powder and the sintered steel that can be manufactured therefrom. Thus, an arrangement causing Mn to be present in a quantity ranging from about 0.03 wt % or more to about 0.1 wt % or less enables Cr to coexist with Mn and S, thus causing graphite to be left or deposited in pores in an amount of about 0.1 wt % or more. Further, the average size of the residual graphite can be made to be about 10 μm or larger. As a result, it found that machinability can be improved significantly if the average particle size of the graphite left in the pores is about 10 μm or larger, the quantity of the same exceeds about 0.05 wt % or more, and MnS simultaneously precipitates into iron particles.

The conventional product manufactured by powder metallurgy suffers from poor machinability as compared with the wrought material product. Although the foregoing problem has been somewhat relieved by the addition of S and MnS, the degree of improvement has not been satisfactory. The powder metallurgy product must in many cases have good wear resistance in addition to its other characteristics to meet the desired purposes. In the foregoing case, it is conventional to add Cr. However, steel containing Cr in a large quantity tends to become hardened excessively when it is sintered and its machinability further deteriorate. Therefore, there arises a necessity of improving its machinability.

As described above, Japanese Patent Laid-Open No. 61-253301 has disclosed an alloy steel powder. The foregoing composition can be obtained mixing water-atomized mother powder prealloyed with powder manufactured by roughly reducing an iron monoxide such as, iron ore or mill scale, by using powder cokes serving as reducing agents; adjusting the mixture in such a manner that the quantity of elements in the alloy is the quantity desired after finishing reducing has been performed; and finish-reducing the mixed powder in a reducing atmosphere. Thus, a very complicated and high-cost manufacturing method is required. Although a composition Cr≧0.31 wt %, Mn≧0.10 wt % and S≧0.16 wt % has been discussed in the examples and comparative examples in the foregoing Japanese disclosure, the basic performance of the powder, such as compressibility, obtained in the examples are unsatisfactory from the viewpoint of practical use. We have investigated steel powders containing Cr, Mn and S as required components in order to develop a steel powder having good basic performance as a powder, such as compressibility, that is satisfactory from the viewpoint of practical use and as well as exhibiting good machinability and wear resistance. Thus, a fact was found that a composition 0.1 wt %≦Cr≦0.3 wt %, 0.03 wt %≦Mn<0.1 wt % and 0.05 wt %≦S≦0.12 wt % that is a range for the foregoing disclosure made in Japanese Patent Laid-Open No. 61-253301 enabled some improvement of machinability over previous powders.

The reason for the limitation of the components of the steel powder and the sintered body in the Japanese reference will now be described.

Since the steel powder according to the present invention causes graphite to be left or deposited in pores in the sintered body due to the coaction of Cr and S, Cr and S must be uniformly distributed in the powder to uniformly distribute graphite in the sintered body. If the foregoing conditions cannot be satisfied, the machinability deteriorate.

S: about 0.05 wt % to 0.12 wt %

Since S partially prevents diffusion of C into γ particles due to its interaction with Cr and forms a sintered steel structure in which graphite is left positioned in pores after the sintering process has been performed, it is added to serve as a S source for generating MnS. The reason why the lower limit of the content of S is made to be about 0.05 wt % is as follows: since S can have strong affinity with Mn, a major portion of S reacts with Mn and precipitates if the content is less than about 0.05 wt %. Furthermore, the interaction of Cr and S prevents diffusion of C into the iron powder particles, causing C to be left in the grain boundary and the pores. Therefore, if the content of S is less than about 0.05 wt %, the foregoing effect of partially preventing the diffusion of C into the iron powder particles cannot be obtained, resulting in that the quantity of graphite left in the grain boundary and the pores is reduced excessively and wear resistance cannot be improved.

It can be considered that the effect of Cr and the residual graphite improve the sliding characteristics of the powder and that the wear resistance can accordingly be improved. In order to improve the machinability and the wear resistances of the powder as described above, it is preferable that the preferred range according to the present invention be employed in which the quantity of Mn is reduced. One reason why the quantity of S is limited to about 0.12 wt % or less is that improvement of wear resistance cannot be expected if it is added in a quantity larger than about 0.12 wt %.

Cr: about 0.1 wt % to 0.3 wt %

In order to improve wear resistance and partially prevent diffusion of C into the γ particles due to cooperation with S to form a sintered steel structure in which graphite is positioned in the pores after the sintering process has been performed, Cr is included. One reason why the quantity of Cr is limited to about 0.1 wt % or more and as well as about 0.3 wt % or less is that the wear resistance of the particles deteriorates if the quantity of Cr is less than 0.1 wt %. If the quantity of Cr is larger than about 0.3 wt %, the solid solution effect with Cr rapidly deteriorates machinability.

Mn: about 0.03 wt % to 0.1 wt %

Mn is added to serve as an Mn source to form MnS. The content of Mn is limited to about 0.03 wt % or more and as well as about 0.1 wt % or less. If Mn is less than about 0.03 wt %, precipitation of MnS is too small to obtain satisfactory machinability. If the quantity of Mn is larger than about 0.1 wt %, the quantity of residual graphite becomes too small to obtain satisfactory machinability and wear resistance. Mn is consumed to form MnS during the atomizing process and the finish reducing process. If the content of Mn is too large, the quantity of S is reduced with respect to the combination of Cr and S which are effective to cause graphite to be left positioned in the pores. Thus, carbonization proceeds during the sintering process, causing the quantity of residual graphite to be reduced.

The preferred range for the residual components and the reason for the determination are as described above.

EXAMPLES

The present invention will now be described specifically with reference to examples of embodiments.

First Embodiment

Examples according to claims 1 and 5 and their comparative examples will now be described.

Table 1 shows the chemical compositions of steel powder according to the examples and the comparative examples.

TABLE 1

| | Steel Powder Chemical Composition | | | | Green Density |
|---|---|---|---|---|---|
| | Cr (wt %) | Mn (wt %) | S (wt %) | O (wt %) | (g/cm$^3$) |
| Example 1 | 0.08 | 0.18 | 0.09 | 0.23 | 6.91 |
| Example 2 | 0.05 | 0.20 | 0.12 | 0.26 | 6.91 |
| Example 3 | 0.07 | 0.15 | 0.25 | 0.26 | 6.86 |
| Example 4 | 0.09 | 0.48 | 0.12 | 0.22 | 6.86 |
| Example 5 | 0.07 | 0.30 | 0.08 | 0.08 | 6.92 |
| Example 6 | 0.08 | 0.25 | 0.15 | 0.15 | 6.91 |
| Example 7 | 0.09 | 0.06 | 0.08 | 0.15 | 6.90 |
| Example 8 | 0.07 | 0.07 | 0.15 | 0.26 | 6.91 |
| Example 9 | 0.09 | 0.15 | 0.008 | 0.15 | 6.91 |
| Example 10 | 0.08 | 0.08 | 0.01 | 0.23 | 6.89 |
| Comparative Example 1 | 0.01 | 0.15 | 0.02 | 0.25 | 6.86 |
| Comparative Example 2 | 0.06 | 0.14 | 0.002 | 0.21 | 6.93 |
| Comparative Example 3 | 0.08 | 0.12 | 0.32 | 0.24 | 6.80 |
| Comparative Example 4 | 0.09 | 0.03 | 0.09 | 0.24 | 6.91 |
| Comparative Example 5 | 0.08 | 0.53 | 0.07 | 0.26 | 6.74 |
| Comparative Example 6 | 0.02 | 0.13 | 0.08 | 0.26 | 6.91 |
| Comparative Example 7 | 0.32 | 0.11 | 0.09 | 0.22 | 6.74 |
| Comparative Example 8 | 0.08 | 0.30 | 0.10 | 0.35 | 6.72 |

The foregoing steel powder was manufactured by a method comprising the steps of drying, at 140° C. for 60 minutes, raw material powder obtained by water-atomizing molten steel; reducing the dried powder at 930° C. for 20 minutes in a pure hydrogen atmosphere, and pulverizing and classifying the reduced substance.

Table 2 collectively shows the evaluated values, the tool lives, tensile strengths and dimensional change ratios (A) and (B) of sintered steel manufactured by molding and sintering the atomized steel powder shown in Table 1.

TABLE 2

| No. | Chemical Composition of Sintered Steel | | | | | Tensile Strength | Tool Life | Dimensional Change Ratio (%) | |
|---|---|---|---|---|---|---|---|---|---|
| | Cr (wt %) | Mn (wt %) | S (wt %) | Cu (wt %) | C (wt %) | (kg/cm$^2$) | (Times) | Dispersion Range (A) | Dispersion Range (B) |
| Example 1 | 0.08 | 0.17 | 0.07 | 1.92 | 0.64 | 47 | 630 | 0.07 | 0.005 |
| Example 2 | 0.05 | 0.20 | 0.11 | 1.95 | 0.62 | 50 | 610 | 0.05 | 0.001 |
| Example 3 | 0.07 | 0.14 | 0.24 | 1.94 | 0.65 | 47 | 620 | 0.06 | 0.006 |
| Example 4 | 0.09 | 0.47 | 0.11 | 1.95 | 0.64 | 53 | 315 | 0.06 | 0.005 |
| Example 5 | 0.07 | 0.29 | 0.08 | 1.95 | 0.64 | 51 | 352 | 0.07 | 0.007 |
| Example 6 | 0.08 | 0.25 | 0.14 | 1.95 | 0.64 | 50 | 456 | 0.08 | 0.007 |
| Example 7 | 0.09 | 0.06 | 0.07 | 1.95 | 0.63 | 52 | 712 | 0.05 | 0.005 |
| Example 8 | 0.07 | 0.07 | 0.14 | 1.98 | 0.64 | 55 | 725 | 0.04 | 0.004 |
| Example 9 | 0.09 | 0.15 | 0.007 | 1.96 | 0.65 | 52 | 315 | 0.08 | 0.007 |
| Example 10 | 0.08 | 0.08 | 0.008 | 1.95 | 0.68 | 51 | 330 | 0.09 | 0.008 |
| Comparative Example 1 | 0.01 | 0.13 | 0.02 | 1.95 | 0.65 | 42 | 33 | 0.16 | 0.04 |
| Comparative Example 2 | 0.05 | 0.13 | 0.002 | 1.94 | 0.64 | 53 | 30 | 0.1 | 0.04 |
| Comparative Example 3 | 0.08 | 0.11 | 0.31 | 1.95 | 0.64 | 36 | 360 | 0.09 | 0.009 |
| Comparative Example 4 | 0.08 | 0.02 | 0.08 | 1.95 | 0.64 | 42 | 150 | 0.08 | 0.008 |
| Comparative Example 5 | 0.08 | 0.51 | 0.07 | 1.98 | 0.64 | 55 | 120 | 0.07 | 0.009 |
| Comparative Example 6 | 0.02 | 0.12 | 0.07 | 1.95 | 0.63 | 43 | 80 | 0.13 | 0.03 |
| Comparative Example 7 | 0.32 | 0.10 | 0.07 | 1.95 | 0.64 | 50 | 40 | 0.15 | 0.008 |
| Comparative Example 8 | 0.08 | 0.29 | 0.08 | 1.94 | 0.62 | 50 | 351 | 0.07 | 0.006 |

The dimensional change during at the time of the sintering process was examined such that graphite powder and copper powder were mixed with pure iron powder and the quantities of graphite in two levels were measured which consisted of Fe-2.0% Cu-0.8% Gr (graphite) and Fe-2.0% Cu-1.0% Gr. The ratio of the difference between the dimensions (with respect to the green compact) of the sintered body of Fe-2.0% Cu-0.8% Gr and those of Fe-2.0% Cu-1.0% Gr (with respect to the green compact) is referred to as dispersion range (A). Each sample had an annular cylindrical shape, the outer diameter of which was 60 mm, the inner diameter of the same was 25 mm and the height of the same was 10 mm. The green density 6.85 g/cm$^3$ and the sample was sintered at 1130° C. for 20 minutes in a nitrogen atmosphere. Furthermore, the dimensions (with respect to the green compact) of the sintered body realized after a sintering process was performed for 30 minutes was examined in the case of the composition Fe-2.0% Cu-0.8% Gr. The ratio of the difference between the dimensions (with respect to the green compact) of the sintered body realized when the sintering process was performed for 20 minutes is referred to as dispersion range (B).

Compressibility was evaluated in accordance with the density of a molded tablet manufactured by adding 1% zinc stearate to each steel powder and having a diameter of 11 mm and a height of 10 mm under a molding pressure of 5 t/cm$^2$.

Machinability were evaluated in such a manner that a cylindrical shape, the outer diameter of which was 60 mm and the height of the same was 10 mm, was formed at a green density of 6.85 g/cm$^3$, sintering was performed at 1130° C. for 20 minutes in a nitrogen atmosphere, and high-speed steel drill having a diameter of 1 mm was used to drill holes under conditions of 10,000 rpm and 0.012 mm/rev. The average number of holes (the average value of three drills) drilled until further drilling could not be performed was evaluated as the tool life.

The green density of pure iron powder available from the market was 6.86 g/cm$^3$ the tensile strength of the sintered steel Fe-2Cu Gr manufactured by molding and sintering the pure iron powder was 42 kg/mm$^2$ and the tool life was 30 times. When sintered steel comprising 0.005 wt % to 0.3 wt % of S, 0.03 wt % to less than 0.3 wt % of Cr, 0.03 wt % to 0.5 wt % or less of Mn, 0.5 to 4.0 wt % of Cu, 0.4 wt % to 1.5 wt % of C and balance consisting of Fe and incidental impurities was manufactured from steel powder comprising 0.005 wt % to 0.3 wt % of S, 0.03 wt % to less than 0.3 wt % of Cr, 0.03 wt % to 0.5 wt % of Mn and a balance consisting of Fe and incidental impurities, both long tool life, which was ten or more times that of the pure iron powder available from the market, and a tensile strength of 47 kg/mm$^2$ was attained. As can be understood from Table 2, any steel powder that satisfies the preferred range that Cr is about 0.03 wt % to less than about 0.1 wt % resulted in an excellent dimensional accuracy such that the dispersion range (A) was about 0.1% or lower and the dispersion range (B) was about 0.01 or lower.

Each of Examples 7 and 8 has a composition included in the preferred range that Cr is 0.06 wt % to 0.09 wt %, S is 0.05 wt % to 0.15 wt % and Mn is 0.05 wt % to 0.15 wt %. Furthermore, Examples 7 and 8 exhibit excellent dimensional stability such that the dispersion range (A) was 0.05% or lower and dispersion range (B) was 0.005% or lower. In addition, the tool life exceeded 600 times. Although Comparative Example 1 is commercial pure iron powder, it suffers from unsatisfactory machinability and inferior dimensional change stability. Comparative Example 2 had a composition wherein the quantity of S was less than 0.005 wt % and it suffered from unsatisfactory machinability and dimensional change stability. Comparative Example 3 indicates that the compressibility deteriorated when the quantity of S was larger than 0.3 wt %. Comparative Example 4 contains Mn in a quantity less than 0.03 wt % and its machinability were not improved significantly. Comparative Example 5 indicates that the compressibility deteriorated when the quantity of Mn was larger than 0.5 wt %. Semi-Comparative Example 6 contained Cr in a quantity less than 0.03 wt %. In this case, both the machinability and the dimensional change stability deteriorated. As can be understood from Semi-Comparative Example 7, equivalent tensile strength to those obtained from the examples of the present invention were realized, that is, the tensile strength were not improved but the green density was less than 6.85 g/cm$^3$ which was too low from the viewpoint of practical use if the quantity of Cr was 0.1 wt % or more. Comparative Example 8 indicates that the compressibility deteriorated if the quantity of oxygen was larger than 0.3 wt %.

Second Embodiment

Examples according to claims 2 and 6 and their comparative examples will now be described.

Table 3 shows the chemical compositions of steel powder according to the examples and the comparative examples.

TABLE 3-1

| | S | Cr | O | Mn | Ni | | | | | | Green | Tool | Dimensional Change Ratio (%) | |
|---|---|---|---|---|---|---|---|---|---|---|---|---|---|---|
| No. | wt % | wt % | wt % | wt % | wt % | Mo wt % | Nb wt % | V wt % | Si wt % | Al wt % | Density (g/cm$^3$) | Life (Times) | Dispersion Range (A) | Dispersion Range (B) |
| Example 11 | 0.09 | 0.09 | 0.10 | 0.07 | 3.9 | | | | | | 7.03 | 355 | 0.07 | 0.007 |
| Example 12 | 0.006 | 0.06 | 0.07 | 0.08 | | 1.5 | | | | | 7.17 | 210 | 0.09 | 0.007 |
| Example 13 | 0.11 | 0.09 | 0.12 | 0.2 | | | 0.05 | | | | 7.21 | 467 | 0.07 | 0.007 |
| Example 14 | 0.29 | 0.07 | 0.18 | 0.4 | | | | 0.06 | | | 7.2 | 445 | 0.06 | 0.007 |
| Example 15 | 0.07 | 0.06 | 0.12 | 0.35 | | | | | 0.02 | | 7.18 | 454 | 0.06 | 0.007 |
| Example 16 | 0.12 | 0.09 | 0.21 | 0.12 | | | | | | 0.08 | 7.17 | 366 | 0.06 | 0.007 |
| Example 17 | 0.12 | 0.07 | 0.13 | 0.07 | 0.5 | 0.3 | | | | | 7.22 | 355 | 0.04 | 0.004 |
| Example 18 | 0.29 | 0.08 | 0.14 | 0.22 | 3 | | 0.003 | | | | 7.1 | 300 | 0.06 | 0.007 |
| Example 19 | 0.14 | 0.06 | 0.15 | 0.13 | 2 | | | 0.3 | | | 7.22 | 365 | 0.04 | 0.005 |
| Example 20 | 0.07 | 0.05 | 0.19 | 0.14 | | 0.5 | 0.005 | | | | 7.19 | 311 | 0.06 | 0.005 |
| Example 21 | 0.06 | 0.06 | 0.25 | 0.12 | | 1.5 | | 0.3 | | | 7.23 | 461 | 0.04 | 0.004 |

TABLE 3-1

| | S | Cr | O | Mn | Ni | | | | | | Green | Tool | Dimensional Change Ratio (%) | |
|---|---|---|---|---|---|---|---|---|---|---|---|---|---|---|
| No. | wt % | wt % | wt % | wt % | wt % | Mo wt % | Nb wt % | V wt % | Si wt % | Al wt % | Density (g/cm$^3$) | Life (Times) | Dispersion Range (A) | Dispersion Range (B) |
| Example 22 | 0.09 | 0.09 | 0.22 | 0.08 | | 1 | 0.003 | 0.2 | | | 7.18 | 411 | 0.09 | 0.007 |
| Example 23 | 0.16 | 0.06 | 0.08 | 0.25 | | 1.5 | | 0.06 | 0.05 | | 7.19 | 370 | 0.07 | 0.008 |
| Example 24 | 0.22 | 0.06 | 0.09 | 0.09 | 1.5 | 1 | 0.04 | | | | 7.2 | 365 | 0.07 | 0.005 |
| Example 25 | 0.11 | 0.07 | 0.15 | 0.06 | 0.5 | 0.3 | | 0.1 | | | 7.23 | 335 | 0.05 | 0.004 |
| Example 26 | 0.07 | 0.07 | 0.14 | 0.08 | 2 | 1.5 | | | 0.02 | | 7.24 | 374 | 0.05 | 0.004 |
| Example 27 | 0.06 | 0.06 | 0.12 | 0.19 | 1.5 | 1 | 0.03 | 0.2 | | 0.08 | 7.18 | 440 | 0.06 | 0.007 |
| Comparative Example 9 | 0.003 | 0.08 | 0.13 | 0.08 | | 1 | | | | | 7.08 | 15 | 0.15 | 0.022 |
| Comparative Example 10 | 0.4 | 0.08 | 0.12 | 0.09 | 0.54 | | | | | | 6.81 | 333 | 0.08 | 0.006 |
| Comparative Example 11 | 0.05 | 0.02 | 0.11 | 0.15 | | | | | | | 7.16 | 33 | 0.11 | 0.015 |
| Comparative Example 12 | 0.22 | 0.6 | 0.14 | 0.11 | | | | | | | 6.88 | 40 | 0.3 | 0.009 |
| Comparative Example 13 | 0.08 | 0.06 | 0.15 | 0.01 | | | | | | 0.008 | 7.19 | 140 | 0.08 | 0.008 |
| Comparative Example 14 | 0.08 | 0.06 | 0.16 | 0.55 | | | | | | 0.008 | 6.88 | 160 | 0.07 | 0.008 |
| Comparative Example 15 | 0.15 | 0.09 | 0.21 | 0.11 | 4.2 | | | | | | 6.75 | 35 | 0.08 | 0.007 |
| Comparative Example 16 | 0.12 | 0.08 | 0.15 | 0.08 | | 4.2 | | | | | 6.77 | 51 | 0.07 | 0.006 |
| Comparative Example 17 | 0.08 | 0.06 | 0.18 | 0.09 | 1.5 | 1 | 0.11 | | | | 6.98 | 32 | 0.06 | 0.007 |
| Comparative Example 18 | 0.14 | 0.06 | 0.20 | 0.45 | 2 | | | 0.6 | | | 6.95 | 30 | 0.07 | 0.008 |
| Comparative | 0.07 | 0.07 | 0.13 | 0.08 | 2 | 1.5 | | | 0.16 | | 7.16 | 25 | 0.05 | 0.006 |

TABLE 3-1-continued

| No. | S wt % | Cr wt % | O wt % | Mn wt % | Ni wt % | Mo wt % | Nb wt % | V wt % | Si wt % | Al wt % | Green Density (g/cm$^3$) | Tool Life (Times) | Dimensional Change Ratio (%) Dispersion Range (A) | Dispersion Range (B) |
|---|---|---|---|---|---|---|---|---|---|---|---|---|---|---|
| Example 19 | | | | | | | | | | | | | | |
| Comparative Example 20 | 0.06 | 0.06 | 0.14 | 0.19 | 1.5 | 1 | 0.003 | 0.2 | | 0.14 | 7.18 | 33 | 0.07 | 0.008 |

The foregoing steel powder was manufactured by drying, at 140° C. for 60 minutes, raw material powder obtained by water-atomizing molten steel; reducing the dried powder at 930° C. for 20 minutes in a pure hydrogen atmosphere, and pulverizing and classifying the reduced substance.

Compressibility was evaluated in accordance with the green density of a molded tablet manufactured by adding 1% zinc stearate (ZnSt) to each steel powder and thus having a composition (Fe-1.0% ZnSt) under a molding pressure of 7 t/cm$^2$, the tablet having a diameter of 11 mm and a height of 10 mm.

Machinability were evaluated. Graphite powder and zinc stearate were mixed with powder as shown in Table 3 so that Fe-0.9 % Gr-1.0% ZnSt was formed, a cylindrical shape, the outer diameter of which was 90 mm and the height of the same was 10 mm, was formed under a green density of 7.00 g/cm$^3$, and a sintering process was performed at 1130° C. in a nitrogen atmosphere for 20 minutes. After the sintering process was completed, high-speed steel drills each having a diameter of 4 mm were used to drill holes under conditions of 10,000 rpm and 0.012 mm/rev. The average number of holes (the average value of three drills) that could be drilled, until further drilling could not be performed, was evaluated as the tool life.

The dimensional change during the sintering process was performed as previously described.

Table 3 shows the results of evaluations of compressibility of steel powder, tool life and ratio of the dimensional change. The atomized steel powder satisfying the requirements according to this invention was blended at a composition of Fe-0.9% Gr-1.0% ZnSt and sintered at 1150° C. for 30 minutes in a nitrogen atmosphere. It resulted in excellent dimensional accuracy such that the tool life was 100 times or more, the dispersion range (A) was 0.10% or lower and the dispersion range (B) was 0.01% or lower.

Examples 17, 19, 21, 25 and 26 represent a preferred composition according to the present invention such that the quantity of Cr is 0.06 wt % or more and as well as 0.09 wt % or less, the quantity of S is 0.05 wt % or more and as well as 0.15 wt % or less and the quantity of Mn is 0.05 wt % or more and as well as 0.15 wt % or less. Further one or more elements selected from the following group were present, the group consisting of 2.0 wt % or less of Ni, 2.0 wt % or less of Mo, 0.01 wt % or more and as well as 0.03 wt % or less of Si, 0.01 wt % or more and as well as 0.03 wt % or less of A1, 0.1 wt % or more and as well as 0.4 wt % or less of V and 0.01 wt % or more and as well as 0.03 wt % or less of Nb. Excellent dimensional change stability was realized such that the dispersion range (A) was 0.05% or lower and dispersion range (B) was 0.005% or lower. Also the tool life was excellent and resulted in 300 times or more.

Comparative Example 9 indicates that if the quantity of S is less than 0.005 wt % the machinability and the dimensional change stability deteriorate. Comparative Example 10 demonstrates that if the quantity of S is greater than 0.3 wt % the compressibility deteriorates. Comparative Example 11 demonstrates that if the quantity of Cr is less than 0.03 wt % the machinability and the dimensional change stability deteriorate. Comparative Example 12 demonstrates that if the quantity of Cr is 0.3 wt % or more the compressibility, machinability and dimensional change stability deteriorate. Comparative Example 13 (containing Al) demonstrates that if the quantity of Mn is less than 0.03 wt % machinability deteriorates. Comparative Example 14 encountered deterioration of compressibility because Mn was present in a quantity larger than 0.5 wt %. Comparative Examples 15 and 16 show that if the quantity of Ni and that of Mo respectively are larger than 4.0 wt % the compressibility deteriorates. If Ni and Mo are each added in an amount of 0.1 wt % or more, strength can be improved as compared with their absence. Comparing Comparative Example 17 and Example 13, compressibility can be improved due to the addition of Nb in an adequate quantity. If this quantity is larger than 0.05 wt %, the machinability and compressibility deteriorate. Comparing Comparative Example 18 and Example 19, the addition of V in an adequate quantity improves compressibility. If this quantity is greater than 0.5 wt %, the machinability and compressibility deteriorate. Comparing Comparative Example 19 and Example 26, the addition of Si in an adequate quantity improves the machinability. If this quantity is larger than 0.1 wt %, compressibility and machinability deteriorate. Comparing Comparative Example 20 and Example 27, the addition of Al in an adequate quantity improves the machinability. If this quantity is larger than 0.1 wt %, the machinability deteriorates.

Third Embodiment

Examples according to claims 3 and 7 and their comparative examples will now be described.

Table 4 shows the chemical composition of each of the examples and the comparative examples.

TABLE 4

| No. | Raw Material Powder S wt % | Cr wt % | O wt % | Mn wt % | Diffusion Alloy Ni wt % | Mo wt % | Cu wt % | Green Density (g/cm$^3$) | Tool Life (Times) | Dimensional Change Ratio (%) Dispersion Range (A) | Dispersion Range (B) |
|---|---|---|---|---|---|---|---|---|---|---|---|
| Example 28 | 0.006 | 0.06 | 0.15 | 0.04 | 0.05 | | | 7.21 | 165 | 0.09 | 0.008 |
| Example 29 | 0.08 | 0.06 | 0.13 | 0.08 | 2 | | | 7.21 | 355 | 0.04 | 0.004 |
| Example 30 | 0.29 | 0.07 | 0.11 | 0.3 | | 0.02 | | 7.21 | 390 | 0.06 | 0.006 |
| Example 31 | 0.14 | 0.06 | 0.15 | 0.2 | | 1.5 | | 7.22 | 290 | 0.07 | 0.007 |
| Example 32 | 0.02 | 0.05 | 0.21 | 0.05 | | | 0.5 | 7.21 | 331 | 0.08 | 0.007 |
| Example 33 | 0.08 | 0.06 | 0.28 | 0.35 | | | 2.5 | 7.22 | 190 | 0.06 | 0.006 |
| Example 34 | 0.008 | 0.06 | 0.07 | 0.48 | 1.5 | 2 | | 7.22 | 185 | 0.09 | 0.009 |
| Example 35 | 0.09 | 0.09 | 0.21 | 0.15 | 2.5 | | 2 | 7.21 | 395 | 0.04 | 0.005 |
| Example 36 | 0.11 | 0.08 | 0.22 | 0.08 | 4 | 0.7 | 1.3 | 7.21 | 350 | 0.04 | 0.004 |
| Comparative Example 21 | 0.003 | 0.08 | 0.15 | 0.1 | 1.5 | | | 7.22 | 31 | 0.15 | 0.013 |
| Comparative Example 22 | 0.35 | 0.06 | 0.12 | 0.08 | 2 | 1 | | 6.85 | 250 | 0.06 | 0.007 |
| Comparative Example 23 | 0.08 | 0.02 | 0.19 | 0.14 | | | 0.5 | 7.21 | 22 | 0.12 | 0.015 |
| Comparative Example 24 | 0.07 | 0.52 | 0.25 | 0.07 | 1 | 1 | | 6.92 | 30 | 0.30 | 0.009 |
| Comparative Example 25 | 0.08 | 0.06 | 0.08 | 0.55 | | 1 | 1 | 6.89 | 151 | 0.07 | 0.007 |
| Comparative Example 26 | 0.06 | 0.07 | 0.21 | 0.11 | 5.3 | | | 7.20 | 15 | 0.06 | 0.006 |
| Comparative Example 27 | 0.22 | 0.08 | 0.16 | 0.08 | | 3.5 | | 7.21 | 25 | 0.08 | 0.006 |
| Comparative Example 28 | 0.08 | 0.09 | 0.15 | 0.13 | | | 5.5 | 7.21 | 26 | 0.07 | 0.008 |

The steel powder was manufactured by a method comprising the steps of: drying, at 140° C. for 60 minutes in a nitrogen atmosphere, raw material powder obtained by water-atomizing molten steel, reducing the dried material in a pure hydrogen atmosphere at 930° C. for 20 minutes, and pulverizing and classifying the reduced substance so that raw material powder comprising S, Cr, Mn and a balance consisting of Fe and unavoidable impurities was manufactured. Ni powder, $MoO_3$ powder and Cu powder, each in predetermined quantity, were mixed with the foregoing raw material powder by using a V-type mixer. The mixed powder was heated to 900° C. for 30 minutes in a gaseous atmosphere in which ammonia was decomposed, and the mixed powder was cooled gradually to obtain partially alloyed powder. The mixed powder was pulverized and classified so that powders having the chemical compositions shown in Table 4 were obtained.

Compressibility, machinability and dimensional change during the sintering process were evaluated by methods as previously described.

Table 4 collectively shows the results of evaluations of compressibility, tool life and ratio of the dimensional change. The steel powders according to this invention were blended at a composition of Fe-0.9% Gr-1.0% ZnSt and sintered at 1150° C. for 30 minutes in a nitrogen atmosphere. They resulted in excellent dimensional accuracy such that the tool life was 100 times or more, the dispersion range (A) was 0.10% or lower and the dispersion range (B) was 0.01% or lower.

Each alloy steel powder according to Examples 29, 35 and 36 had a composition within the preferred range of the present invention, such that one or more substance selected from a group consisting of 4 wt % or less of a Ni source, 2 wt % or less of a Mo source and 2.0 wt % or less of a Cu source were partially alloyed with steel powder having a composition wherein the quantity of Cr was 0.06 wt % to 0.09 wt %, the quantity of S was 0.05 wt % to 0.15 wt % and the quantity of Mn was 0.05 wt % to 0.15 wt %: Excellent dimensional change stability was exhibited such that the dispersion range (A) was 0.05% or less and dispersion range (B) was 0.005% or less. Furthermore, the tool life resulted in drilling 300 times or more.

Comparative Example 21 demonstrates that when the quantity of S was less than 0.005 wt % the machinability and dimensional change stability deteriorated. Comparative Example 22 shows that when the quantity of S was larger than 0.3 wt % the compressibility deteriorated. Comparative Example 23 shows that when the quantity of Cr was less than 0.03 wt % the machinability and dimensional change stability deteriorated. Comparative Example 24 shows that when the quantity of Cr was 0.3 wt % or more the compressibility machinability and dimensional change stability deteriorated. Comparative Example 25 demonstrates that when the quantity of Mn was larger than 0.5 wt % the compressibility deteriorated. When the quantity of Mn was less than 0.03 wt %, no effect was obtained to improve compressibility, machinability or dimensional accuracy. Comparative Examples 26, 27 and 28 show that when the Ni source, the Mo source and the Cu source respectively were larger than 5.0, 3.0 and 5.0 wt % the machinability deteriorated. It is preferable that the Ni source and the Mo source be added in an amount of 0.1 wt % or more and the Cu source be added in an amount of 0.5 wt % or more to improve strength as compared with their absence.

Fourth Embodiment

Examples and comparative examples according to claims 4 and 8 will now be described.

Tables 5 and 6 show the chemical composition of each steel powder for use in the examples and the comparative examples. The steel powder was manufactured by drying, at 140° C. for 60 minutes in a nitrogen atmosphere, raw material powder obtained by water-atomizing molten steel, reducing the dried material in a pure hydrogen atmosphere at 930° C. for 20 minutes, and pulverizing and classifying the reduced substance. The raw material powder comprised alloy components shown in Table 5 and the balance consisted of Fe and incidental impurities. Ni powder, $MoO_3$ powder and Cu powder were mixed with the thus-manufactured raw material powder by using a V-type mixer. The mixed powder was heated to 900° C. for 30 minutes in a gaseous atmosphere in which ammonia was decomposed, and the mixed powder was cooled gradually to obtain partially alloyed steel powder. The partially alloyed powder was pulverized and classified so that powders having the chemical compositions shown in Table 5 and 6 were obtained.

The compressibility, machinability and dimensional change stability were evaluated as heretofore described.

Tables 5 and 6 show the results of the evaluations of the powder compressibility, tool life and dimensional change during due to the sintering process.

TABLE 5

| No.* | Raw Material Powder S wt % | Cr wt % | O wt % | Mn wt % | Ni wt % | Mo wt % | Nb wt % | V wt % | Si wt % | Al wt % | Diffusion Alloy Ni wt % | Mo wt % | Cu wt % | Green Density (g/cm³) | Total Quantity of Mo % | Tool Life (Times) | Dimensional Change Ratio (%) Dispersion Range (A) | Dispersion Range (B) |
|---|---|---|---|---|---|---|---|---|---|---|---|---|---|---|---|---|---|---|
| Ex. 37 | 0.008 | 0.06 | 0.14 | 0.04 | 0.31 | | | | | | 2 | | | 7.14 | 0 | 171 | 0.09 | 0.009 |
| Ex. 38 | 0.09 | 0.09 | 0.12 | 0.15 | 3.9 | | | | | | | 1.5 | 3 | 7.05 | 1.5 | 210 | 0.07 | 0.007 |
| Ex. 39 | 0.08 | 0.08 | 0.19 | 0.08 | | 0.6 | | | | | 2.5 | | | 7.18 | 0.6 | 285 | 0.06 | 0.008 |
| Ex. 40 | 0.11 | 0.09 | 0.21 | 0.3 | | | 0.03 | | | | | 1.5 | | 7.23 | 1.5 | 294 | 0.06 | 0.007 |
| Ex. 41 | 0.14 | 0.06 | 0.10 | 0.4 | | | | 0.45 | | | 5 | | | 7.21 | 0 | 284 | 0.07 | 0.006 |
| Ex. 42 | 0.11 | 0.06 | 0.09 | 0.03 | 2 | 1 | | | | 0.03 | 1 | 0.5 | | 7.20 | 1.5 | 402 | 0.04 | 0.005 |
| Ex. 43 | 0.07 | 0.07 | 0.19 | 0.09 | | 0.5 | 0.03 | | | | | 0.02 | | 7.21 | 0.52 | 410 | 0.04 | 0.006 |
| Ex. 44 | 0.16 | 0.06 | 0.25 | 0.14 | | 1.5 | | 0.06 | 0.05 | | | | 4 | 7.2 | 1.5 | 235 | 0.05 | 0.008 |
| Ex. 45 | 0.11 | 0.07 | 0.15 | 0.24 | 0.5 | 0.03 | | 0.1 | | | 2.5 | | 3 | 7.19 | 0.3 | 264 | 0.06 | 0.007 |
| Ex. 46 | 0.07 | 0.07 | 0.10 | 0.11 | 2 | 1.5 | | | 0.02 | | 3 | | 0.5 | 7.21 | 1.5 | 320 | 0.05 | 0.005 |

Column No.* - - - - Ex. means Example.

TABLE 6

| No.* | Raw Material Powder S wt % | Cr wt % | O wt % | Mn wt % | Ni wt % | Mo wt % | Nb wt % | V wt % | Si wt % | Al wt % |
|---|---|---|---|---|---|---|---|---|---|---|
| Comp. 29 | 0.003 | 0.08 | 0.08 | 0.15 | | 0.6 | | | | |
| Comp. 30 | 0.45 | 0.07 | 0.11 | 0.08 | 2 | | | | | |
| Comp. 31 | 0.48 | 0.02 | 0.13 | 0.14 | 1 | 0.5 | | | | |
| Comp. 32 | 0.19 | 0.52 | 0.15 | 0.08 | 3 | | | | | |
| Comp. 33 | 0.25 | 0.08 | 0.16 | 0.55 | | 1.5 | | | | |
| Comp. 34 | 0.14 | 0.06 | 0.22 | 0.07 | 4.5 | | | | | |
| Comp. 35 | 0.06 | 0.07 | 0.12 | 0.09 | | 4.3 | | | | |
| Comp. 36 | 0.11 | 0.09 | 0.18 | 0.3 | | | 0.11 | | | |
| Comp. 37 | 0.14 | 0.06 | 0.15 | 0.4 | | | | 0.56 | | |
| Comp. 38 | 0.07 | 0.07 | 0.13 | 0.11 | 2 | 1.5 | | | 0.16 | |
| Comp. 39 | 0.11 | 0.06 | 0.18 | 0.05 | 2 | 1 | | | | 0.14 |
| Comp. 40 | 0.15 | 0.08 | 0.17 | 0.12 | | 0.5 | | | | |
| Comp. 41 | 0.22 | 0.07 | 0.16 | 0.05 | 1 | 1 | | | | |
| Comp. 42 | 0.08 | 0.09 | 0.13 | 0.08 | | | 0.08 | | | |

| No.* | Diffusion Alloy Ni wt % | Mo wt % | Cu wt % | Green Density (g/cm³) | Total Quantity of Mo % | Tool Life (Times) | Dimensional Change Ratio (%) Dispersion Range (A) | Dispersion Range (B) |
|---|---|---|---|---|---|---|---|---|
| Comp. 29 | 3 | | | 7.18 | 0.6 | 26 | 0.14 | 0.015 |
| Comp. 30 | | | 1 | 6.89 | 0 | 271 | 0.05 | 0.008 |
| Comp. 31 | | 0.5 | | 7.19 | 1 | 30 | 0.11 | 0.012 |
| Comp. 32 | | | 2.5 | 6.79 | 0 | 40 | 0.12 | 0.01 |
| Comp. 33 | | | 1 | 6.85 | 1.5 | 184 | 0.07 | 0.008 |
| Comp. 34 | | 1 | | 6.89 | 1 | 32 | 0.06 | 0.007 |
| Comp. 35 | 0.5 | | | 6.88 | 4.3 | 27 | 0.07 | 0.008 |
| Comp. 36 | | 1.5 | | 6.91 | 1.5 | 30 | 0.08 | 0.007 |
| Comp. 37 | 5 | | | 6.88 | 0 | 41 | 0.08 | 0.007 |
| Comp. 38 | | | 0.5 | 7.17 | 1.5 | 31 | 0.07 | 0.007 |

TABLE 6-continued

| | | | | | | | | |
|---|---|---|---|---|---|---|---|---|
| Comp. 39 | 1 | 0.5 | | 7.16 | 1.5 | 34 | 0.07 | 0.006 |
| Comp. 40 | 5.2 | | | 7.18 | 0.5 | 25 | 0.07 | 0.006 |
| Comp. 41 | | 3.3 | | 7.18 | 4.3 | 35 | 0.05 | 0.005 |
| Comp. 42 | | | 5.1 | 7.19 | 0 | 40 | 0.06 | 0.007 |

Column No.* - - - - Comp. means Comparative Example.

The steel powder blended into Fe-0.9% Gr-lo0% ZnSt was sintered at 1150° C. for 30 minutes in a nitrogen atmosphere so that excellent dimensional accuracy was realized, such that the tool life was 100 times or more, the dispersion range (A) was 0.10% or less and the dispersion range (B) was 0.01% or less. Examples 42, 43 and 46 each show alloy steel powders according to the present invention and manufactured in such a manner that one or more elements selected from a group consisting of 4.0 wt % or less of Ni, 2.0 wt % or less of Mo and 2.0 wt % or less of Cu were partially alloyed with steel powder previously formed into alloy and containing Cr 0.06 wt % to 0.09 wt %, S 0.05 wt % to 0.15 wt %, Mn 0.05 wt % to 0.15 wt %, and further containing one or more elements selected from the group consisting of 2.0 wt % or less of Ni, 2.0 wt % or less of Mo, 0.01 wt % to 0.03 wt % of Si, 0.01 wt % to 0.03 wt % of Al, 0.1 wt % to 0.4 wt % of V and 0.01 wt % to 0.03 wt % of Nb. The mixed substance was subjected to heat treatment so as to be diffused, and was allowed to adhere. Excellent dimensional change stability was realized such that the dispersion range (A) was 0.05% or lower and the dispersion range (B) was 0.005% or lower. Furthermore, the tool life was 300 drilling times or more.

Comparative Example 29 shows that when the quantity of S was less than 0.005 wt % the machinability and the dimensional change stability deteriorated. Comparative Example 30 shows that when the quantity of S was larger than 0.3 wt % the compressibility deteriorated. Comparative Example 31 shows that when the quantity of Cr was less than 0.03 wt % the machinability and dimensional change stability deteriorated. Comparative Example 32 shows that when the quantity of Cr was 0.3 wt % or more the compressibility, machinability and dimensional change stability deteriorated. Comparative Example 33 shows that when the quantity of Mn was larger than 0.5 wt % the compressibility deteriorated. When the quantity of Mn was less than 0.03 wt %, machinability could not be improved. Comparative Examples 34 and 35 show that when the quantity of Ni and that of Mo in the raw material powder were greater than 4.0 wt % the compressibility and machinability deteriorated. When the quantity of Ni and that of Mo in the raw material powder were less than 0.1 wt %, the strength could not be improved as compared with the case where the foregoing elements were not added. Also from the viewpoint of reducing the cost of alloying the elements, foregoing case is not practical. Comparing Comparative Example 36 and Example 40, the addition of Nb improved the compressibility and machinability. When the quantity was greater than 0.05 wt %, the compressibility and the machinability deteriorated. Comparing Comparative Example 37 and Example 41, the addition of V improved the compressibility. When the quantity was larger than 0.5 wt %, the machinability and the compressibility deteriorated. Comparing Comparative Example 38 and Example 46, the addition of 0.09% Si in Example 46 improved the machinability. When the Si quantity was greater than 0.1 wt %, machinability deteriorated. Comparing Comparative Example 39 and Example 42, the addition of Al in Example 42 improved the machinability. When the quantity of Al was greater than 0.1 wt %, machinability deteriorated. In accordance with Comparative Examples 40, 41 and 42, the machinability deteriorated when the quantities of Ni, Mo and Cu were larger than 5.0 wt %, 3.0 wt % and 5.0 wt %, respectively. When the quantity of Ni and that of Mo which are partially alloyed were 0.1 wt % or more and the quantity of Cu was 0.5 wt % or more, strength improved as compared with the case where the foregoing elements were not added.

Fifth Embodiment

Examples and Comparative Examples according to claims 1 to 8, 13 and 14 will now be described.

Turning now to Table 7, graphite and 1.0 wt % zinc stearate were blended and mixed with the steel powder having the composition shown in Table 7. Then, greeng density was controlled at 6.85 g/cm$^3$ in the molding process, and sintering was performed at 1130° C. for 20 minutes in a nitrogen atmosphere. Table 7 collectively shows tool life and dimensional change stability.

TABLE 7

| | Raw Material Powder | | | | | | | | | |
|---|---|---|---|---|---|---|---|---|---|---|
| No.* | S wt % | Cr wt % | O wt % | Mn wt % | Ni wt % | Mo wt % | Nb wt % | V wt % | Si wt % | Al wt % |
| Ex. 47 | 0.08 | 0.06 | 0.13 | 0.08 | | | | | | |
| Ex. 48 | 0.15 | 0.09 | 0.12 | 0.15 | 0.4 | 0.4 | 0.003 | 0.15 | 0.03 | 0.02 |
| Ex. 49 | 0.2 | 0.07 | 0.15 | 0.2 | | | | | | |
| Ex. 50 | 0.11 | 0.08 | 0.18 | 0.06 | 0.1 | 1.5 | 0.005 | 0.3 | 0.02 | 0.03 |
| Comp. 43 | 0.1 | 0.08 | 0.15 | 0.11 | | 1 | | 0.3 | | |
| Comp. 44 | 0.22 | 0.09 | 0.12 | 0.4 | 0.5 | 1 | 0.003 | | 0.02 | |

| | Diffusion Alloy | | | Quantity | Greeng | Tool | Dispersion Range | | Residual |
|---|---|---|---|---|---|---|---|---|---|
| No.* | Ni wt % | Mo wt % | Cu wt % | of C Added | Density (g/cm$^3$) | Life (Times) | (A) % | (B) | Graphite % |
| Ex. 47 | | | | 0.5 | 7.25 | 551 | 0.07 | 0.004 | 0.06 |

TABLE 7-continued

| | | | | | | | | | |
|---|---|---|---|---|---|---|---|---|---|
| Ex. 48 | | | | 1.0 | 7.21 | 334 | 0.06 | 0.006 | 0.1 |
| Ex. 49 | 0.3 | 0.5 | 0.2 | 0.8 | 7.22 | 355 | 0.08 | 0.008 | 0.15 |
| Ex. 50 | 2 | 0.2 | 0.1 | 0.8 | 7.21 | 377 | 0.06 | 0.006 | 0.15 |
| Comp. 43 | 3.5 | | 0.5 | 0.3 | 7.21 | 291 | 0.16 | 0.015 | 0.01 |
| Comp. 44 | | 2 | 1 | 5.5 | 7.22 | 34 | 0.08 | 0.008 | 4.0 |

Column No.* - - - Ex. means Example and Comp. means Comparative Example.

The tool life and dimensional change stability were evaluated in accordance with the first and second embodiments.

The quantity of residual graphite was measured by dissolving the powder with nitric acid, filtrating with a glass filter, and the residual graphite quantity on the filter was determined by means of Infra-red spectroscopy.

Mn and S in sintered body were analyzed by using an Electron Probe X-ray Microanalyzer (hereinafter called an "EPMA") and existence of Mn and S was confirmed if these two elements were present.

Examples 47 to 50 each contained C by 0.4 wt % to 1.5 wt % and resulted in excellent dimensional change stability such that the tool lives were 300 times or more and the dispersion range (B) was lower than 0.01%. Comparative Example 43 was sintered steel containing C in a quantity less than 0.4 wt % and resulted in unsatisfactory dimensional change stability. Comparative Example 44 shows that when the quantity of C was larger than 1.5 wt % the machinability deteriorated.

Examples of the present invention cause graphite to be present in the powder in a quantity of about 0.05 wt % or more. As a result of C-mapping using the EPMA, graphite was concentrically positioned in pores and MnS was precipitated over the structure. The ruptured surfaces of tensile strength test pieces were observed and this was confirmed by energy dispersive X-ray spectroscopic (hereinafter called "EDX") analysis. The sizes of fifty inclusion containing Mn and S were measured, resulting in factual observations that these sizes were 5 μm or less without exception.

Thus, the steel powder according to the present invention has created a novel and effective sintered steel in which graphite particles are present in pores, wherein MnS having a size smaller than about 5 μm is present in the iron particles and grain boundary, and which exhibits excellent machinability, dimensional change stability and strength.

Sixth Embodiment

Examples according to claim 9 and its comparative examples will now be described.

Table 8 shows the chemical compositions of steel powder for use in the examples and the comparative examples.

TABLE 8

| No. | Cr wt % | Mn wt % | S wt % | O wt % | Green Density (g/cm$^3$) | Quantity of Graphite Added | Tool Life (Times) | Wear Quantity (μm) | Generation of Soot | Quantity of Residual Graphite (wt %) | Size of Residual Graphite |
|---|---|---|---|---|---|---|---|---|---|---|---|
| Example 51 | 0.10 | 0.09 | 0.08 | 0.15 | 6.91 | 0.8 | 650 | 15 | nil | 0.1 | 16 |
| Example 52 | 0.20 | 0.07 | 0.08 | 0.17 | 6.89 | 0.8 | 620 | 15 | nil | 0.11 | 15 |
| Example 53 | 0.30 | 0.07 | 0.11 | 0.19 | 6.87 | 0.8 | 640 | 18 | nil | 0.1 | 15 |
| Example 54 | 0.15 | 0.06 | 0.06 | 0.24 | 6.87 | 0.4 | 625 | 12 | nil | 0.12 | 16 |
| Example 55 | 0.13 | 0.05 | 0.05 | 0.28 | 6.88 | 0.8 | 630 | 13 | nil | 0.15 | 17 |
| Example 56 | 0.28 | 0.05 | 0.05 | 0.28 | 6.88 | 1.2 | 610 | 14 | nil | 0.45 | 15 |
| Example 57 | 0.23 | 0.08 | 0.12 | 0.24 | 6.89 | 0.8 | 600 | 15 | nil | 0.2 | 12 |
| Example 58 | 0.11 | 0.03 | 0.07 | 0.13 | 6.88 | 0.8 | 640 | 15 | nil | 0.22 | 14 |
| Comparative Example 45 | 0.05 | 0.06 | 0.06 | 0.25 | 6.75 | 0.8 | 630 | 81 | nil | 0.05 | 15 |
| Comparative Example 46 | 0.5 | 0.09 | 0.12 | 0.17 | 6.87 | 0.8 | 30 | 8 | nil | 0.25 | 9 |
| Comparative Example 47 | 0.2 | 0.01 | 0.1 | 0.19 | 6.86 | 0.8 | 24 | 15 | nil | 0.12 | 13 |
| Comparative Example 48 | 0.13 | 0.15 | 0.12 | 0.16 | 6.86 | 0.8 | 230 | 18 | nil | 0.06 | 15 |
| Comparative Example 49 | 0.25 | 0.07 | 0.02 | 0.17 | 6.87 | 0.8 | 240 | 16 | nil | 0.06 | 15 |
| Comparative Example 50 | 0.3 | 0.06 | 0.35 | 0.16 | 6.86 | 0.8 | 600 | 14 | generate | 0.2 | 15 |
| Comparative Example 51 | 0.3 | 0.07 | 0.06 | 0.35 | 6.72 | 0.8 | 30 | 13 | nil | 0.05 | 5 |
| Comparative Example 52 | 0.22 | 0.08 | 0.08 | 0.22 | 6.87 | 0.2 | 32 | 40 | nil | 0.02 | 8 |
| Comparative Example 53 | 0.15 | 0.08 | 0.09 | 0.22 | 6.87 | 5.2 | 40 | 12 | nil | 3.4 | 13 |

The foregoing steel powder was manufactured by drying, at 140° C. for 60 minutes, raw material powder obtained by water-atomizing molten steel; reducing the dried powder at 930° C. for 20 minutes in a pure hydrogen atmosphere, and pulverizing and classifying the reduced powder.

Zinc stearate was added to each steel powder in an amount of 1 wt % and a tablet having a diameter of 11 mm and a height of 10 mm was molded under a molding pressure of 5 t/cm$^2$, resulting in the green densities shown in Table 8. All steel powder according to the examples of the present invention resulted in a green density of 6.85 g/cm$^3$ or higher.

Then, 2 wt % of copper powder, 1 wt % of zinc stearate and graphite powder in a quantity shown in Table 8 were mixed with the foregoing steel powder and a disc-like shape was molded. It had an outer diameter of 60 mm and a height of 10 mm and had a green density of 6.85 g/cm$^3$. The molded part was sintered at 1130° C. for 20 minutes in $N_2$ atomosphere. Its machinability were evaluated by a method as previously described.

Wear resistance was evaluated by an Okoshi-Test-Method. As an index for wear resistance, the wear quantity confirmed as a result of a test performed for 10 hours was employed.

Table 8 collectively shows the results of machinability tests and wear resistance tests. In the case where the steel powder according to Examples 51 to 57 was sintered, a small wear quantity of 12 to 18 μm was confirmed as compared with Comparative Example 45 containing Cr in a small quantity. Furthermore, the tool life was maintained at 600 times or more and no generation of soot was confirmed after the sintering process had been performed, thus protecting the furnace from contamination.

On the other hand, semi-comparative example 45 containing Cr in a small quantity was within the scope of the present invention but did not meet the preferred range within which both wear resistance and the machinability are improved. Wear resistance was found to deteriorate. Comparative Example 48 and 49 are within the broad scope of the present invention but are not included within the preferred range in which both wear resistance and machinability can be improved. Because the quantity of Mn is too large and that of S is too small. The tool life in these Examples is somewhat inferior to that realized by Examples 51 to 58. Comparative Example 51 containing oxygen in a large quantity results in inferior machinability. Comparative Example 50 containing S in a large quantity encounters generation of soot after the sintering process has been performed. Comparative Examples 46 and 47 containing Cr in a large content and Mn in a small content, respectively, have poor machinability.

The quantity of residual graphite was determined by the same method as previously described.

If prealloying powder containing Cr, Mn and S results in residual graphite of 0.1 wt % or more, the average size of the same is about 10 μm or larger, and excellent machinability can be obtained. In any case the formed MnS had a small size of 3 μm or smaller. Comparative Example 47 which contained Mn in too small quantity to form any substantial amount of MnS showed unsatisfactory machinability. Thus, it can be understood that MnS also present in the sintered steel is required to improve its machinability.

As a result of C-mapping by means of the EPMA, graphite was found to have been concentrically left positioned in pores.

Comparative Example 52 containing added graphite in a small quantity resulted in a quantity of residual graphite which was less than about 0.05 wt %. In the foregoing case, graphite left in pores was not found by C-mapping by means of the EPMA. The machinability were unsatisfactory.

Seventh Embodiment

Examples and comparative examples according to claim 10 will now be described.

Table 9 shows the chemical compositions of steel powders according to examples and comparative examples.

TABLE 9

| No. | Cr wt % | Mn wt % | S wt % | O wt % | Ni wt % | Mo wt % | Nb wt % | V wt % | Si wt % | Al wt % |
|---|---|---|---|---|---|---|---|---|---|---|
| Example 59 | 0.25 | 0.09 | 0.08 | 0.16 | 2 | | | | | |
| Example 60 | 0.25 | 0.05 | 0.12 | 0.24 | | 1.5 | | | | |
| Example 61 | 0.28 | 0.03 | 0.05 | 0.07 | | | 0.01 | | | |
| Example 62 | 0.23 | 0.06 | 0.12 | 0.24 | | | | 0.1 | | |
| Example 63 | 0.19 | 0.07 | 0.08 | 0.28 | | | | | 0.1 | |
| Example 64 | 0.18 | 0.05 | 0.11 | 0.13 | | | | | | 0.02 |
| Example 65 | 0.15 | 0.08 | 0.06 | 0.18 | 2 | 1 | | | 0.02 | |
| Example 66 | 0.13 | 0.05 | 0.05 | 0.28 | 1.5 | 1 | | | | 0.03 |
| Example 67 | 0.28 | 0.03 | 0.05 | 0.24 | | 1.5 | 0.02 | 0.15 | | |
| Example 68 | 0.20 | 0.08 | 0.08 | 0.15 | 1.5 | 1 | 0.02 | 0.1 | 0.01 | 0.01 |
| Comparative Example 54 | 0.05 | 0.08 | 0.11 | 0.25 | | | | | 0.03 | 0.05 |
| Comparative Example 55 | 0.5 | 0.09 | 0.12 | 0.22 | 0.5 | 1 | | | | |
| Comparative Example 56 | 0.23 | 0.01 | 0.08 | 0.19 | | 0.5 | | | | |
| Comparative Example 57 | 0.19 | 0.15 | 0.06 | 0.16 | | | | 0.15 | | |
| Comparative Example 58 | 0.11 | 0.08 | 0.02 | 0.17 | 1 | 1 | | | | |
| Comparative Example 59 | 0.18 | 0.06 | 0.33 | 0.16 | | | 0.05 | | | |
| Comparative Example 60 | 0.25 | 0.07 | 0.11 | 0.35 | | | | | 0.1 | |
| Comparative Example 61 | 0.15 | 0.09 | 0.08 | 0.15 | 4.5 | | 0.02 | | | |
| Comparative Example 62 | 0.13 | 0.06 | 0.12 | 0.22 | | 4.3 | | | | |
| Comparative Example 63 | 0.28 | 0.08 | 0.09 | 0.22 | | | 0.07 | 0.1 | | |
| Comparative Example 64 | 0.29 | 0.04 | 0.06 | 0.15 | | 2 | | 0.6 | | |
| Comparative Example 65 | 0.25 | 0.06 | 0.11 | 0.18 | 1 | | | | 0.13 | |
| Comparative Example 66 | 0.15 | 0.07 | 0.12 | 0.16 | | 3 | | | | 0.12 |
| Comparative Example 67 | 0.13 | 0.08 | 0.06 | 0.18 | 2 | 1 | | | 0.02 | |
| Comparative Example 68 | 0.3 | 0.08 | 0.06 | 0.18 | 2 | 1 | | | 0.02 | |

The steel powder was manufactured in such a manner that raw material powder obtained by water-atomizing molten steel was dried at 140° C. for 60 minutes, the dried raw material powder was reduced at 930° C. for 20 minutes in a pure hydrogen atmosphere, and the reduced substance was pulverized and classified. The compressibility of the obtained steel powder was evaluated by a method in accordance with that previously described. All steel powder according to the present invention resulted in a green density of about 6.85 g/cm$^3$ or higher under a molding pressure of 5 t/cm$^2$.

Then, 1 wt % of zinc stearate and graphite in quantities shown in Table 10 were mixed with each of the foregoing steel powder. A disc-like shape having an outer diameter of 60 mm and a height of 10 mm was molded at a green density of 6.85 g/cm$^3$ before the disc-like sample was sintered at 1130° C. for 20 minutes in a nitrogen atmosphere.

The machinability and wear resistance were evaluated by the same methods as those previously described.

Table 10 collectively shows the results of machinability tests and wear resistance tests.

TABLE 10

| No. | Green Density (g/cm$^3$) | Quantity Graphite Added (%) | Tool Life (Times) | Wear Quantity (μm) | Generation of Soot | Quantity of Residual Graphite (wt %) | Size of Residual Graphite |
|---|---|---|---|---|---|---|---|
| Example 59 | 6.87 | 0.6 | 330 | 10 | nil | 0.22 | 35 |
| Example 60 | 6.83 | 0.8 | 330 | 15 | nil | 0.25 | 32 |
| Example 61 | 6.88 | 0.8 | 405 | 11 | nil | 0.25 | 16 |
| Example 62 | 6.89 | 0.8 | 408 | 15 | nil | 0.15 | 18 |
| Example 63 | 6.89 | 0.8 | 375 | 10 | nil | 0.12 | 15 |
| Example 64 | 6.89 | 0.8 | 350 | 14 | nil | 0.14 | 35 |
| Example 65 | 6.87 | 0.8 | 352 | 13 | nil | 0.25 | 34 |
| Example 66 | 6.88 | 0.8 | 372 | 13 | nil | 0.22 | 32 |
| Example 67 | 6.92 | 0.8 | 328 | 14 | nil | 0.2 | 33 |
| Example 68 | 6.91 | 0.8 | 325 | 13 | nil | 0.21 | 31 |
| Comparative Ex. 54 | 6.89 | 0.8 | 341 | 45 | nil | 0.07 | 16 |
| Comparative Ex. 55 | 6.78 | 0.8 | 20 | 8 | nil | 0.24 | 10 |
| Comparative Ex. 56 | 6.88 | 0.8 | 40 | 13 | nil | 0.12 | 31 |
| Comparative Ex. 57 | 6.89 | 0.8 | 185 | 14 | nil | 0.06 | 15 |
| Comparative Ex. 58 | 6.88 | 0.8 | 170 | 14 | nil | 0.07 | 14 |
| Comparative Ex. 59 | 6.85 | 0.8 | 320 | 15 | generate | 0.2 | 15 |
| Comparative Ex. 60 | 6.86 | 0.8 | 25 | 17 | nil | 0.02 | 4 |
| Comparative Ex. 61 | 6.78 | 0.8 | 35 | 10 | nil | 0.12 | 12 |
| Comparative Ex. 62 | 6.80 | 0.8 | 30 | 4 | nil | 0.15 | 11 |
| Comparative Ex. 63 | 6.80 | 0.8 | 25 | 1 | nil | 0.24 | 15 |
| Comparative Ex. 64 | 6.81 | 0.8 | 30 | 7 | nil | 0.13 | 32 |
| Comparative Ex. 65 | 6.83 | 0.8 | 15 | 6 | nil | 0.15 | 32 |
| Comparative Ex. 66 | 6.84 | 0.8 | 30 | 3 | nil | 0.2 | 12 |
| Comparative Ex. 67 | 6.87 | 0.3 | 75 | 48 | nil | 0.01 | 7 |
| Comparative Ex. 68 | 6.87 | 5.2 | 25 | 8 | nil | 3.3 | 30 |

When steel powder according to examples 59 to 68 was sintered, a wear quantity of 10 μm to 15 μm was confirmed that was significantly smaller than that confirmed with Comparative Example 54 containing Cr in a small quantity. Furthermore, the tool life was maintained at 320 times or more. In addition, soot generation was prevented after the sintering process had been performed, thus causing the furnace to be protected from contamination.

On the other hand, Comparative Example 54 containing Cr in a small quantity was within the broad scope of the present invention, but did not meet the preferred range with which both wear resistance and the machinability are improved. The wear resistance deteriorated Comparative Examples 57 and 58 were within the broad scope of the present invention. However, they were not included within the preferred range, in which both wear resistance and machinability are improved, because the quantity of Mn is too large and that of S is too small. Tool life was somewhat inferior to that realized by Examples 59 to 68. Comparative Example 60 containing oxygen in a large quantity resulted in inferior machinability. Comparative Examples 55 and 56 containing Cr in a large content and Mn in a small content, respectively, have poor machinability.

Comparative Example 59 containing S in a large quantity encountered generation of soot after the sintering process had been performed. Comparative Examples 61 to 66 respectively containing Ni, Mo, Nb, V, Si and Al in quantities larger than desirable resulted in inferior machinability.

The quantity of residual graphite was determined by the same method as that previously employed. Examples 59 to 68 resulted in a quantity of residual graphite of 0.10 wt % or more, without exception. The average size of the residual graphite was 10 μm or larger, and thus excellent machinability were obtained. As a result of C-mapping by means of the EPMA, graphite was found concentrically present in pores.

On the other hand, Comparative Example 60 containing oxygen in a large quantity and Comparative Example 67 containing added graphite in a small quantity resulted in residual graphite in a quantity which was less than 0.10 wt %. No residual graphite was observed in pores by C-mapping by means of the EPMA. Thus, the machinability were unsatisfactory.

When Ni and Mo in prealloyed alloy was smaller than 2 wt % within the preferred range of the present invention, and in a case where quantity of Ni, Mo and Cu partially alloyed respectively are 4, 2 and 2 wt % or smaller, the size of the residual graphite is 30 μm or larger. Thus, it will be understood that deterioration of machinability during due to hardening caused from solid solution can be prevented.

Eighth Embodiment

Examples and comparative examples according to claim 11 will now be described.

Table 11 shows the chemical compositions of iron powder for use in examples of the present invention and their comparative examples.

TABLE 11

| No.* | Raw Material Powder Cr wt % | Mn wt % | S wt % | O wt % | Diffusion Alloy Ni wt % | Mo wt % | Cu wt % | Green Density (g/cm³) | Quantity of Graphite Added (wt % | Tool Life ) (Times) | Wear Quantity (μm) | Genera-tion of Soot | Quantity of Residual Graphite (wt %) | Size of Residual Graphite |
|---|---|---|---|---|---|---|---|---|---|---|---|---|---|---|
| Ex. 69 | 0.25 | 0.04 | 0.12 | 0.24 | 0.5 | | | 6.88 | 0.8 | 302 | 10 | nil | 0.22 | 32 |
| Ex. 70 | 0.13 | 0.05 | 0.05 | 0.07 | 4.5 | | | 6.89 | 0.8 | 320 | 10 | nil | 0.14 | 22 |
| Ex. 71 | 0.28 | 0.08 | 0.05 | 0.24 | | 0.3 | | 6.90 | 0.8 | 310 | 10 | nil | 0.2 | 34 |
| Ex. 72 | 0.1 | 0.09 | 0.08 | 0.13 | | 3 | | 6.90 | 0.8 | 190 | 12 | nil | 0.14 | 22 |
| Ex. 73 | 0.3 | 0.07 | 0.11 | 0.19 | | | 3 | 6.89 | 0.8 | 190 | 14 | nil | 0.18 | 32 |
| Ex. 74 | 0.15 | 0.06 | 0.06 | 0.16 | 2 | 1 | | 6.90 | 1.5 | 330 | 10 | nil | 0.22 | 32 |
| Ex. 75 | 0.28 | 0.05 | 0.05 | 0.24 | | 2 | 0.5 | 6.90 | 0.8 | 230 | 13 | nil | 0.2 | 30 |
| Ex. 76 | 0.29 | 0.08 | 0.08 | 0.07 | 4 | 0.3 | 1.5 | 6.90 | 0.8 | 305 | 12 | nil | 0.21 | 35 |
| Comp. Ex. 69 | 0.05 | 0.06 | 0.06 | 0.25 | 0.5 | 1 | | 6.89 | 0.8 | 315 | 51 | nil | 0.07 | 13 |
| Comp. Ex. 70 | 0.5 | 0.09 | 0.12 | 0.22 | | 0.5 | 2 | 6.80 | 0.8 | 11 | 12 | nil | 0.24 | 10 |
| Comp. Ex. 71 | 0.2 | 0.01 | 0.2 | 0.1 9 | 1 | | | 6.89 | 0.8 | 9 | 13 | nil | 0.16 | 30 |
| Comp. Ex. 72 | 0.13 | 0.15 | 0.12 | 0.16 | | 0.3 | 1 | 6.87 | 0.8 | 160 | 12 | nil | 0.07 | 15 |
| Comp. Ex. 73 | 0.25 | 0.07 | 0.02 | 0.17 | | 1.5 | | 6.88 | 0.8 | 170 | 13 | nil | 0.06 | 13 |
| Comp. Ex. 74 | 0.3 | 0.06 | 0.37 | 0.21 | 3 | 0.5 | | 6.89 | 0.8 | 225 | 12 | generate | 0.17 | 14 |
| Comp. Ex. 75 | 0.3 | 0.07 | 0.06 | 0.36 | 2 | | | 6.73 | 0.8 | 12 | 11 | nil | 0.05 | 3 |
| Comp. Ex. 76 | 0.22 | 0.08 | 0.08 | 0.21 | 6 | | 1 | 6.89 | 0.8 | 7 | 13 | nil | 0.13 | 11 |
| Comp. Ex. 77 | 0.15 | 0.08 | 0.09 | 0.18 | | 3.5 | | 6.90 | 0.8 | 8 | 15 | nil | 0.16 | 10 |
| Comp. Ex. 78 | 0.15 | 0.06 | 0.06 | 0.25 | | 1 | 5.5 | 6.89 | 0.8 | 6 | 13 | nil | 0.19 | 12 |
| Comp. Ex. 79 | 0.13 | 0.05 | 0.05 | 0.22 | 1 | 1.5 | | 6.89 | 0.3 | 10 | 38 | nil | 0.02 | 10 |
| Comp. Ex. 80 | 0.28 | 0.05 | 0.05 | 0.15 | 1 | 1.5 | | 6.89 | 5.4 | 4 | 15 | nil | 3.9 | 30 |

The steel powder was manufactured by drying, at 140° C. for 60 minutes in a nitrogen atmosphere, raw material powder obtained by water-atomizing molten steel, reducing the dried material in a pure hydrogen atmosphere at 930° C. for 20 minutes, and pulverizing and classifying the reduced substance so that raw material powder containing S, Cr, Mn and a balance consisting of Fe and incidental impurities was manufactured. Then, Ni powder, $MoO_3$ powder and Cu powder were mixed with the thus-manufactured raw material powder by using a V-type mixer. The mixed powder was heated to 900° C. for 30 minutes in a gaseous atmosphere in which ammonia was decomposed, and the mixed powder was cooled gradually to obtain partially alloyed powder. Then, the partially alloyed powder was pulverized and classified so that powders having the chemical compositions shown in Table 11 were obtained.

Then, 1 wt % of zinc stearate and graphite in a quantity shown in Table 11 were mixed with each of the foregoing iron powders and a disc-like shape having an outer diameter of 60 mm and a height of 10 mm was molded at a green density of 6.85 g/cm³ before the disc-like sample was sintered at 1130° C. for 20 minutes in a nitrogen atmosphere. The machinability and wear resistance were evaluated by the same methods as those previously employed.

Table 11 collectively shows the results of machinability tests and wear resistance tests. When iron powder according to Examples 69 to 76 was sintered, a significantly small wear quantity of 10 μm to 14 μm resulted as compared with Comparative Example 69 containing Cr in a small quantity. Furthermore, the tool life was maintained at 190 times or more. In addition, no soot was generated after the sintering process had been performed and contamination of the furnace was prevented.

Although Comparative Example 69 containing Cr in a small quantity is within the broad scope of the present invention, it resulted in inferior wear resistance and good machinability. Comparative Example 72 containing Mn in a large quantity and Comparative Example 73 containing S in a small quantity are within the broad scope of the present invention, the quantity of bin is too large and that of S is too small with respect to the range in which both wear resistance and the machinability are improved and resulted in machinability being inferior to Examples 69 to 76.

Comparative Example 75 containing oxygen in a large quantity results in inferior machinability.

Comparative Example 74 containing S in a large quantity encountered generation of soot after the sintering process had been performed. Comparative Examples 70 and 71 containing Cr in a large content and Mn in a small content, respectively, have poor machinability. Comparative Examples 76 to 78 containing Ni, Mo and Cu, which are partially alloyed, in quantities that are larger than optimum, resulted in unsatisfactory machinability.

The quantity of residual graphite was determined by the same method previously employed. Examples 69 to 76 resulted in a residual graphite quantity of 0.10 wt % or more without exception, the graphite having an average size of 10 μm or larger. Thus, excellent machinability were realized. As a result of C-mapping by means of the EPMA, graphite was concentrically found in pores.

Comparative Example 79 containing added graphite in a small quantity resulted in residual graphite in a quantity less than 0.10 wt %. No graphite was left in the pores, as confirmed by C-mapping by means of the EPMA. The machinability were unsatisfactory.

When the quantities of Ni and Mo were 2 wt % or less in the alloy formed previously, and when the quantities of Ni, Mo and Cu, which are partially alloyed, respectively were 4, 2 and 2 wt % or less, the size of residual graphite was 30 μm or larger. Thus, it can be understood that deterioration of the machinability due to hardening caused from solid solution can be prevented.

Ninth Embodiment

Examples according to claim 12 and its comparative examples will now be described. Table 12 shows the chemical compositions of powders for use in the examples and the comparative examples.

TABLE 12

(unit: wt %)

| | Raw Material Powder | | | | | | | | | | Diffusion Alloy | | |
|---|---|---|---|---|---|---|---|---|---|---|---|---|---|
| No.* | S | Mn | S | O | Ni | Mo | Nb | V | Si | Al | Ni | Mo | Cu |
| Ex. 77 | 0.3 | 0.07 | 0.11 | 0.15 | 3.9 | | | | | | | 0.5 | |
| Ex. 78 | 0.13 | 0.05 | 0.05 | 0.24 | | 1.5 | | | | | 2 | 0.5 | 1.5 |
| Ex. 79 | 0.29 | 0.08 | 0.08 | 0.13 | | | 0.05 | | | | 2 | | |
| Ex. 80 | 0.19 | 0.07 | 0.08 | 0.19 | | | | 0.5 | | | 2 | 1 | |
| Ex. 81 | 0.18 | 0.05 | 0.11 | 0.28 | | | | | 0.1 | | 3 | 0.5 | 1.5 |
| Ex. 82 | 0.13 | 0.05 | 0.05 | 0.07 | | | | | | 0.05 | | 1.5 | |
| Ex. 83 | 0.28 | 0.03 | 0.05 | 0.18 | 2 | 1 | | | | | | | 1 |
| Ex. 84 | 0.25 | 0.06 | 0.12 | 0.16 | | | | 0.15 | 0.03 | 0.01 | | 0.3 | 2 |
| Ex. 85 | 0.15 | 0.06 | 0.06 | 0.17 | | 0.5 | 0.02 | | 0.01 | 0.02 | 2 | 0.5 | 0.2 |
| Ex. 86 | 0.13 | 0.05 | 0.05 | 0.16 | 0.2 | 0.2 | 0.02 | 0.1 | 0.01 | 0.01 | 2 | 1 | 0.1 |
| Comp. 81 | 0.05 | 0.06 | 0.06 | 0.22 | 1 | | | | 0.03 | | 1 | | |
| Comp. 82 | 0.5 | 0.09 | 0.12 | 0.18 | | 2 | | 0.2 | | | | 0.5 | |
| Comp. 83 | 0.2 | 0.01 | 0.1 | 0.19 | | 1 | | | 0.05 | | | | 2 |
| Comp. 84 | 0.13 | 0.15 | 0.12 | 0.16 | 3 | | | 0.15 | | | 2 | 1 | |
| Comp. 85 | 0.25 | 0.07 | 0.02 | 0.17 | 1 | 1 | | | | | | 0.5 | |
| Comp. 86 | 0.3 | 0.06 | 0.32 | 0.16 | | | 0.05 | | | | | 1 | 2 |
| Comp. 87 | 0.3 | 0.07 | 0.06 | 0.35 | | | | | 0.1 | | 0.5 | 0.5 | |
| Comp. 88 | 0.25 | 0.06 | 0.12 | 0.15 | 4.5 | 1 | | | | | | 0.5 | |
| Comp. 89 | 0.15 | 0.06 | 0.06 | 0.22 | | 4.3 | | | | | | | 0.5 |
| Comp. 90 | 0.13 | 0.05 | 0.05 | 0.22 | 1 | | 0.07 | | | | 1 | 3 | |
| Comp. 91 | 0.28 | 0.05 | 0.05 | 0.15 | | 1 | | 0.6 | | | | 0.5 | |
| Comp. 92 | 0.29 | 0.08 | 0.08 | 0.18 | 2 | | | | 0.13 | | | | 2 |
| Comp. 93 | 0.23 | 0.08 | 0.12 | 0.16 | | 1 | | | | 0.12 | 1 | | 2 |
| Comp. 94 | 0.25 | 0.05 | 0.12 | 0.24 | | 1.5 | | | | | 2 | 0.5 | 1.5 |
| Comp. 95 | 0.18 | 0.08 | 0.06 | 0.16 | | | | 0.15 | 0.03 | | | 0.3 | 2 |
| Comp. 96 | 0.13 | 0.11 | 0.05 | 0.22 | | 0.2 | | | | | 5.2 | | |
| Comp. 97 | 0.25 | 0.08 | 0.06 | 0.26 | 1.2 | | | | | | | 3.2 | |
| Comp. 98 | 10.12 | 0.09 | 0.05 | 0.18 | | | 1.5 | | | | | | 5.1 |

Column No.* - - - Ex. means Example and Comp. means Comparative Example.

The steel powder was manufactured by drying, at 140° C. for 60 minutes in a nitrogen atmosphere, raw material powder obtained by water-atomizing molten steel, reducing the dried material in a pure hydrogen atmosphere at 930° C. for 20 minutes, and pulverizing and classifying the reduced substance so that raw material powder comprising S, Cr, Mn, Ni, Mo, Nb, V, Si and Al and the balance consisting of Fe and incidental impurities was manufactured. Then, Ni powder, $MoO_3$ powder and Cu powder were mixed with the thus-manufactured raw material powder by using a V-type mixer. The mixed powder was heated to 900° C. for 30 minutes in a gaseous atmosphere in which ammonia was decomposed, and the mixed powder was cooled gradually to obtain partially alloyed steel powder. The partially alloyed powder was pulverized and classified so that powders having the chemical compositions shown in Table 12 were obtained.

1 wt % of zinc stearate and graphite in quantities shown in Table 12 were mixed with each of the iron powders and a disc-like shape having an outer diameter of 60 mm and a height of 10 mm was molded at a green density of 6.85 g/cm$^3$ before the disc-like sample was sintered at 1130° C. for 20 minutes in a nitrogen atmosphere.

The machinability and the wear resistance were evaluated by the same methods as those previously employed.

Table 13 collectively shows the results of the machinability tests and the wear resistance tests.

TABLE 13

| No. | Green Density (g/cm$^3$) | Quantity of Graphite Added (%) | Tool Life (Times) | Wear Quantity (μm) | Generation of Soot | Quantity of Residual Graphite (wt %) | Size of Residual Graphite |
|---|---|---|---|---|---|---|---|
| Example 77 | 6.87 | 0.8 | 780 | 12 | nil | 0.13 | 21 |
| Example 78 | 6.88 | 0.8 | 190 | 12 | nil | 0.13 | 32 |
| Example 79 | 6.87 | 0.8 | 220 | 12 | nil | 0.22 | 31 |
| Example 80 | 6.87 | 0.8 | 230 | 12 | nil | 0.15 | 31 |
| Example 81 | 6.87 | 1.2 | 270 | 12 | nil | 0.37 | 32 |
| Example 82 | 6.88 | 0.8 | 270 | 13 | nil | 0.11 | 35 |
| Example 83 | 6.89 | 0.8 | 280 | 14 | nil | 0.13 | 30 |

TABLE 13-continued

| No. | Green Density (g/cm³) | Quantity of Graphite Added (%) | Tool Life (Times) | Wear Quantity (μm) | Generation of Soot | Quantity of Residual Graphite (wt %) | Size of Residual Graphite |
|---|---|---|---|---|---|---|---|
| Example 84 | 6.90 | 0.8 | 210 | 12 | nil | 0.16 | 30 |
| Example 85 | 6.90 | 0.8 | 215 | 13 | nil | 0.21 | 32 |
| Example 86 | 6.90 | 0.8 | 220 | 12 | nil | 0.22 | 35 |
| Comparative Ex. 81 | 6.90 | 0.8 | 230 | 45 | nil | 0.06 | 13 |
| Comparative Ex. 82 | 6.75 | 0.8 | 15 | 13 | nil | 0.24 | 9 |
| Comparative Ex. 83 | 6.88 | 0.8 | 35 | 12 | nil | 0.15 | 31 |
| Comparative Ex. 84 | 6.90 | 0.8 | 120 | 13 | nil | 0.06 | 12 |
| Comparative Ex. 85 | 6.88 | 0.8 | 130 | 14 | nil | 0.06 | 12 |
| Comparative Ex. 86 | 6.86 | 0.8 | 205 | 13 | generate | 0.2 | 21 |
| Comparative Ex. 87 | 6.75 | 0.8 | 8 | 12 | nil | 0.06 | 6 |
| Comparative Ex. 88 | 6.80 | 0.8 | 7 | 13 | nil | 0.13 | 21 |
| Comparative Ex. 89 | 6.83 | 0.8 | 9 | 15 | nil | 0.15 | 20 |
| Comparative Ex. 90 | 6.82 | 0.8 | 10 | 14 | nil | 0.22 | 13 |
| Comparative Ex. 91 | 6.82 | 0.8 | 7 | 13 | nil | 0.15 | 31 |
| Comparative Ex. 92 | 6.84 | 0.8 | 8 | 13 | nil | 0.17 | 30 |
| Comparative Ex. 93 | 6.84 | 0.8 | 11 | 14 | nil | 0.18 | 31 |
| Comparative Ex. 94 | 6.88 | 0.3 | 9 | 40 | nil | 0.02 | 31 |
| Comparative Ex. 95 | 6.59 | 5.3 | 6 | 14 | nil | 3.5 | 30 |
| Comparative Ex. 96 | 6.68 | 0.8 | 7 | 13 | nil | 0.12 | 22 |
| Comparative Ex. 97 | 6.87 | 0.8 | 10 | 12 | nil | 0.14 | 21 |
| Comparative Ex. 98 | 6.88 | 0.8 | 11 | 13 | nil | 0.13 | 20 |

When iron powder according to Examples 77 to 86 was sintered, a small wear result of 11 μm to 14 μm was realized as compared with Comparative Example 81 containing Cr in a small quantity. Furthermore, tool life was maintained at 190 times or more. In addition, no soot generation was confirmed and thus the furnace was protected from contamination.

Although Comparative Example 81 containing Cr in a small quantity meets the broad scope of the present invention, it is not within the range in which both wear resistance and the machinability can be improved. Therefore the wear resistance deteriorated. Comparative Example 84 containing Mn in a large quantity and Comparative Example 85 containing S in a small quantity are included within the broad scope of the present invention, they are not included in the preferred range in which both wear resistance and machinability can be improved because the quantity of Mn is too large and that of S is too small. In this case, the tool life is somewhat inferior to that realized by Examples 77 to 86. Comparative Example 87 containing oxygen in a large quantity results in inferior machinability. Comparative Example 86 containing S in a large quantity encountered generation of soot after the sintering process had been performed. Comparative Example 82 and 83 containing Cr in a large content and Mn in a small content, respectively, have poor machinability. Comparative Examples 81 to 93 and 96 to 98 containing Ni, Mo, Nb, V, Si and Al in the raw material powder thereof and Ni, Mo and Cu which are dispersion and adhering materials in large quantities encountered unsatisfactory machinability.

The quantity of residual graphite was determined by the same method as that previously employed. Examples 77 to 86 resulted in a quantity of residual graphite of 0.10 wt % or larger without exception and the graphite had an average size of 10 μm or larger. Thus, excellent machinability were realized. As a result of C-mapping using the EPMA, graphite was found concentrically positioned in the pores.

On the other hand, Comparative Example 94 containing added graphite in a small quantity caused graphite to be present in a quantity less than 0.10 wt %. As a result of C-mapping using EPMA, no residual graphite was found and the machinability were unsatisfactory.

When Ni and Mo in prealloyed alloy was 2 wt % or less and when Ni, Mo and Cu, which are partially alloyed, respectively are 4 wt % or less, 2 wt % or less and 2 wt % or less, the size of residual graphite was 30 μm or larger. Thus, deterioration of machinability due to hardening caused from solid solution can be prevented.

As a result, according to the present invention, atomized steel powder exhibiting excellent machinability, dimensional accuracy and wear resistance and sintered steel manufactured therefrom can be manufactured and used with great advantage.

Although the invention has been described in its preferred forms with a certain degree of particularly, it will be understood that although certain forms of the invention concurrently provide many different advantages including excellent machinability, excellent dimensional accuracy, excellent wear resistance and freedom of soot formation, others of the powders within the scope of this invention may provide one or more of these advantages and remain within the scope of this invention. Thus, it will be understood that the present disclosure of various preferred forms can be changed in details all as explained in detail in the specification and examples, all without departing from the spirit and the scope of the invention as claimed.

What is claimed is:

1. Atomized steel powder having excellent machinability and satisfactory dimensional accuracy, comprising about:

S 0.05 wt % to 0.15 wt %;

Cr 0.03 wt % to less than 0.1 wt %;

Mn 0.03 wt % to 0.5 wt %;

O 0.3 wt % or less; and the balance Fe and incidental impurities.

2. Atomized steel powder according to claim 1 further comprising about:

one or more elements selected from the group consisting essentially of about:

4.0 wt % or less of Ni, 4.0 wt % or less of Mo,
0.05 wt % or less of Nb,
0.5 wt % or less of V,
0.1 wt % or less of Si, and
0.1 wt % or less of Al.

3. Atomized steel powder having excellent machinability and satisfactory dimensional accuracy, which comprises said steel powder, according to claim 1, wherein is admixed with at least one component selected from the group consisting of about:

5.0 wt % or less of a Ni-containing material, 3.0 wt % or less of a Mo-containing material, and 5.0 wt % or less of a Cu-containing material, and said admixed alloy steel powder is heat treated and subjected to diffusion alloying;

and said atomized steel powder consisting essentially of about:
0.05 wt % to 0.15 wt % of S,
0.05 wt % to less than 0.1 wt % of Cr,
0.03 wt % to 0.5 wt % of Mn,
0.3 wt % or less of O, at least one element selected from the group consisting essentially of about:
5.0 wt % or less of Ni,
3.0 wt % or less of Mo,
5.0 wt % or less of Cu, and the balance Fe and incidental impurities.

4. Atomized steel powder having excellent machinability and satisfactory dimensional accuracy, which comprises said steel powder, according to claim 2, which is admixed with at least one component selected from the group consisting of about:

5.0 wt % or less of an Ni-containing material, 3.0 wt % or less of an Mo-containing material, and 5.0 wt % or less of a Cu-containing material, and said admixed alloy steel powder is heat treated and subjected to diffusion alloying;

and said atomized steel powder consisting essentially of about:
0.05 wt % to 0.15 wt % of S,
0.05 wt % to less than 0.1 wt % of Cr,
0.03 wt % to 0.5 wt % of Mn,
0.3 wt % or less of O, at least one element selected from the group consisting essentially of about:
9.0 wt % or less of Ni,
7.0 wt % or less of Mo,
5.0 wt % or less of Cu, and at least one element selected from the group consisting essentially of about:
0.05 wt % or less of Nb,
0.5 wt % or less of V,
0.1 wt % or less of Si,
0.1 wt % or less of Al, and the balance Fe and incidental impurities.

5. Atomized steel powder having excellent machinability and satisfactory wear resistance, comprising about:

0.05 wt % to 0.12 wt % of S;

0.1 wt % to 0.3 wt % of Cr;

0.03 wt % to 0.1 wt % of Mn;

0.3 wt % or less of O; and the balance Fe and incidental impurities.

6. Atomized steel powder having excellent machinability and satisfactory wear resistance according to claim 5 further comprising about:

one or more elements selected from the group consisting of:
4.0 wt % or less of Ni,
4.0 wt % or less of Mo,
0.05 wt % or less of Nb,
0.5 wt % or less of V,
0.1 wt % or less of Si, and
0.1 wt % or less of Al.

7. Atomized steel powder having excellent machinability and satisfactory wear resistance, which comprises said steel powder, according to claim 5, which is admixed with at least one component selected from the group consisting of about:

5.0 wt % or less of an Ni-containing material, 3.0 wt % or less of an Mo-containing material, and 5.0 wt % or less of a Cu-containing material, and said admixed alloy steel powder is heat treated and subjected to diffusion alloying;

and said atomized steel powder consisting essentially of about:
0.05 wt % to 0.12 wt % of S,
0.1 wt % to 0.3 wt % of Cr,
0.03 wt % to 0.1 wt % of Mn,
0.3 wt % or less of O, and at least one element selected from the group consisting essentially of about:
5.0 wt % or less of Ni,
3.0 wt % or less of Mo,
5.0 wt % or less of Cu, and the balance Fe and incidental impurities.

8. Atomized steel powder having excellent machinability and satisfactory wear resistance, which comprises said steel powder, according to claim 6, which is admixed with at least one component selected from the group consisting of about:

5.0 wt % or less of a Ni-containing material, 3.0 wt % or less of a Mo-containing material, and 5.0 wt % or less of a Cu-containing material;

and said admixed alloy steel powder is heat treated and subjected to diffusion alloying;

and said atomized steel powder consisting essentially of about:
0.05 wt % to 0.12 wt % of S,
0.1 wt % to 0.3 wt % of Cr,
0.03 wt % to 0.1 wt % of Mn,
0.3 wt % or less of O, at least one element selected from the group consisting essentially of about:
9.0 wt % or less of Ni,
7.0 wt % or less of Mo,
5.0 wt % or less of Cu, and at least one element selected from the group consisting essentially of about:
0.05 wt % or less of Nb,
0.5 wt % or less of V,
0.1 wt % or less of Si,
0.1 wt % or less of Al, and the balance Fe and incidental impurities.

9. Sintered steel made from green compact of mixture of an atomized steel powder according to any one of claims 1 to 8, wherein about 0.4 to 1.5 wt % of C is present therein.

* * * * *

UNITED STATES PATENT AND TRADEMARK OFFICE

CERTIFICATE OF CORRECTION

PATENT NO. : 5,571,305

DATED : November 5, 1996

INVENTOR(S) : Satoshi Uenosono et al

It is certified that error appears in the above-indentified patent and that said Letters Patent is hereby corrected as shown below:

Column 2, line 2, please change "5 0" to --5.0--; and line 10, please change "7.2 g/cm$^3$ since" to --7.2 g/cm$^3$. Since--.

Columns 13 and 14, Table 2, under heading "Chemical Composition of Sintered Steel," under subheading "S (wt%)", at Comparative Example 7, please change "0.07" to --0.08--.

Column 14, line 34, please change "6.86 g/cm$^3$" to --6.86 g/cm$^3$,--.

Columns 15 and 16, Table 3-1, under heading "Dimensional Change Ratio (%)", subheading "Dispersion Range (B)", at Example 24, please change "0.005" to --0.006--.

Columns 19 and 20, Table 4, under heading "Dimensional Change Ratio (%)", subheading "Dispersion Range (B)", at Example 32, please change "0.007" to --0.006--.

Columns 21 and 22, Table 6, under heading "Raw Material Powder", subheading "S wt%", at Comp. 31, please change "0.48" to --0.08--; and Table 6, under heading "Dimensional Change Ratio (%)", subheading "Dispersion Range (A)", at Comp. 30, please change "0.05" to --0.06--.

Column 23, line 10, please change "Gr-1o0%" to --Gr-1.0%--.

UNITED STATES PATENT AND TRADEMARK OFFICE

CERTIFICATE OF CORRECTION

PATENT NO. : 5,571,305

DATED : November 5, 1996

INVENTOR(S) : Satoshi Uenosono et al

It is certified that error appears in the above-indentified patent and that said Letters Patent is hereby corrected as shown below:

Columns 27 and 28, Table 9, under heading "S wt%", at Comparative Example 59, please change "0.33" to --0.35--.

Columns 31 and 32, Table 11, under heading "Raw Material Powder", subheading "S wt%", at Comp. Ex. 71, please change "0.2" to --0.1--.

Columns 33 and 34, Table 12, under heading "Raw Material Powder, subheading "S", at Comp. 98, please change "10.12" to --0.12--.

Signed and Sealed this

Twenty-first Day of January, 1997

*Attest:*

*Attesting Officer*

Bruce Lehman

BRUCE LEHMAN

*Commissioner of Patents and Trademarks*